US007797834B2

(12) United States Patent
Steunenberg et al.

(10) Patent No.: US 7,797,834 B2
(45) Date of Patent: Sep. 21, 2010

(54) SHAVING DEVICE WITH A PIVOTABLE SHAVING HEAD CARRYING AN ACTIVELY DRIVEN CUTTING MEMBER

(75) Inventors: Roelof Steunenberg, Drachten (NL); Peter Hans Van Der Vlis, Drachten (NL); Robert Alexander Van Eibergen Santhagens, Drachten (NL); Marinus Christiaan Hansen, Hoogeveen (NL); Marc Alexander Pastoors, Drachten (NL); Dirk Hendrik Wevers, Drachten (NL); Aafje Gijsbertha Koster, Eindhoven (NL); Gerardus Joannes Henricus Roddeman, Son en Breugel (NL); Richard Pieter Ophof, Drachten (NL); Hendrik Klaas Paauw, Hoogeveen (NL); Gerben Raap, Drachten (NL); Raymond Wilhelmus Louis Lafarre, Eindhoven (NL); Johannes Cornelius Antonius Muller, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 246 days.

(21) Appl. No.: 10/581,535

(22) PCT Filed: Dec. 1, 2004

(86) PCT No.: PCT/IB2004/052622

§ 371 (c)(1),
(2), (4) Date: Jun. 1, 2006

(87) PCT Pub. No.: WO2005/053917

PCT Pub. Date: Jun. 16, 2005

(65) Prior Publication Data

US 2007/0151106 A1 Jul. 5, 2007

(30) Foreign Application Priority Data

Dec. 2, 2003 (EP) ..... 03104488
Apr. 26, 2004 (EP) ..... 04101733

(51) Int. Cl.
*B26B 19/28* (2006.01)
*B26B 21/00* (2006.01)
*B26B 21/52* (2006.01)

(52) U.S. Cl. ..... 30/50; 30/42; 30/527

(58) Field of Classification Search ..... 30/43.45, 30/34.2, 41–43, 50, 51, 60, 63, 65, 527, 530, 30/533, 58–59
See application file for complete search history.

(56) References Cited

U.S. PATENT DOCUMENTS

| | | | | |
|---|---|---|---|---|
| 2,054,418 | A | 9/1936 | Hartmann Nee Bohm | |
| 4,744,144 | A * | 5/1988 | Lowery et al. | 30/45 |
| 5,007,169 | A * | 4/1991 | Motta | 30/45 |
| 5,299,354 | A * | 4/1994 | Metcalf et al. | 30/45 |
| 5,794,342 | A * | 8/1998 | Davey | 30/45 |
| 6,105,252 | A * | 8/2000 | Andis | 30/45 |
| 6,421,918 | B1 * | 7/2002 | Dato et al. | 30/45 |
| 6,502,318 | B1 * | 1/2003 | Gilder | 30/530 |
| 7,028,405 | B2 * | 4/2006 | Paas et al. | 30/45 |
| 2006/0037197 | A1 * | 2/2006 | Hawes et al. | 30/45 |

FOREIGN PATENT DOCUMENTS

| | | |
|---|---|---|
| DE | 10140639 A1 | 5/2002 |
| WO | WO 2004/018165 | 3/2004 |

* cited by examiner

*Primary Examiner*—Ghassem Alie
*Assistant Examiner*—Bharat C Patel

(57) ABSTRACT

A device for shaving hairs growing from skin including a base portion having a grip, a shaving head which carries at least one cutting member having at least one cutting edge, and an actuator for effecting a periodical motion of the cutting member relative to the base portion to improve the cutting action of the cutting member. The shaving head is pivotable relative to the base portion about a pivot axis and the periodical motion of the cutting member is a periodical motion relative to the shaving head. The position and orientation of the geometrical path of the periodical motion of the cutting member relative to the skin is well-defined, so that the risk of skin irritations and skin injuries is considerably reduced.

20 Claims, 13 Drawing Sheets

SHAVING DEVICE WITH A PIVOTABLE SHAVING HEAD CARRYING AN ACTIVELY DRIVEN CUTTING MEMBER

The invention relates to a device for shaving hairs growing from skin, comprising a base portion having a grip, a shaving head carrying at least one blade-shaped cuffing member having at least one cutting edge, and an actuator for effecting a periodical motion of the cutting member relative to the base portion.

The invention also relates to a shaving head suitable for use in a device for shaving hairs growing from skin, the shaving head carrying at least one blade-shaped cutting member having at least one cutting edge, the shaving head further comprising a coupling member by means of which the shaving head can be coupled to a base portion of said device, said base portion comprising a grip and an actuator for effecting a periodical motion of the cutting member relative to the base portion.

A device for shaving hairs of the kind mentioned in the opening paragraphs is known from U.S. Pat. No. 2,054,418. The shaving head of the known device comprises a blade-shaped cutting member. The actuator of the known device comprises an electric motor, which is arranged in the base portion and has a shaft to which a flywheel is eccentrically secured. The flywheel is located in the shaving head of the known device and extends substantially parallel to the main surfaces of the cutting member. The shaft is supported by two bearings, one of which is also arranged in the shaving head. During operation, when the flywheel is rotated by the motor, the flywheel exerts periodical forces on the bearings. Via the bearing arranged in the shaving head, said forces are transmitted to the shaving head and effect a circular periodical motion of the shaving head and of the cutting member mounted therein relative to the base portion. The circular periodical motion of the cutting member takes place substantially in an imaginary plane parallel to the main surfaces of the cutting member. As a result of said periodical motion of the cutting member, the device has an improved hair cutting action.

A disadvantage of the known device for shaving hairs is that the risk of skin irritations and skin injuries is considerably increased as a result of the periodical motion of the cutting member.

It is an object of the invention to provide a device for shaving hairs and a shaving head of the kinds mentioned in the opening paragraphs which have an improved hair cutting action as a result of the periodical motion of the blade-shaped cutting member, but which have a smaller risk of skin irritations and skin injuries.

In order to achieve said object, a device for shaving hairs in accordance with the invention is characterized in that the shaving head is pivotable relative to the base portion about a pivot axis, and the periodical motion of the cutting member is a periodical motion relative to the shaving head.

In order to achieve said object, a shaving head in accordance with the invention is characterized in that the periodical motion of the cutting member is a periodical motion relative to the shaving head, and the shaving head comprises a pivot member by means of which, in a condition where the shaving head is mounted to the base portion, the shaving head is pivotable relative to the base portion about a pivot axis.

The invention is based on the insight that, for a shaving device wherein the blade-shaped cutting member performs a periodical motion, the risk of skin irritations and skin injuries is considerably reduced if the geometrical path, which is followed by the cutting member during the periodical motion, has a well-defined position and orientation with respect to the skin surface. Since in accordance with the invention the shaving head is pivotable relative to the base portion, the position and orientation of said geometrical path are less dependent on, or even independent of, the position and orientation of the base portion with respect to the skin surface, so that the position and orientation of said geometrical path are less dependent on the manner in which the user holds the grip in his hand and holds his hand with respect to the skin surface. As a result of said pivot axis, the position and orientation of said geometrical path are mainly determined by the contact forces between the shaving head and the skin surface. Said contact forces lead to a pivotal motion of the shaving head about the pivot axis into a position, in which the shaving head is in optimum contact with the skin and in which, accordingly, the geometrical path of the cutting member has a well-defined position and orientation with respect to the skin surface. Since, in addition, the periodical motion of the cutting member is a periodical motion relative to the shaving head, the shaving head is stationary with respect to the base portion apart from pivotal motions about said pivot axis. As a result, the position and orientation of the geometrical path of the periodical motion of the cutting member relative to the skin are even better defined.

A particular embodiment of a device for shaving hairs in accordance with the invention is characterized in that the shaving head comprises a skin contact member defining a skin contact surface, the pivot axis extending substantially parallel to the skin contact surface. As a result, the shaving head has a further improved skin-contour following ability, so that the position and orientation of the geometrical path of the periodical motion of the cutting member with respect to the skin surface are even better defined and the risk of skin irritations and skin injuries is further reduced.

A particular embodiment of a device for shaving hairs in accordance with the invention is characterized in that the periodical motion has a motion component which extends substantially parallel to a main cutting direction of the cutting member, the pivot axis extending substantially perpendicularly to the main cutting direction. The hair cutting action of the device is considerably improved as a result of said motion component extending parallel to the main cutting direction, and said orientation of the pivot axis perpendicular to the main cutting direction, i.e. parallel to said motion component, provides an optimum skin-contour following ability of the shaving head having said motion component.

A further embodiment of a device for shaving hairs in accordance with the invention is characterized in that the periodical motion is a reciprocating motion in a direction substantially parallel to the main cutting direction. The hair cutting action of the device is further improved as a result of said reciprocating motion in said direction substantially parallel to the main cutting direction.

A further embodiment of a device for shaving hairs in accordance with the invention is characterized in that the cutting member comprises a single straight cutting edge, the pivot axis extending parallel to the cutting edge and, seen in the main cutting direction, being arranged in front of the cutting edge. In this manner, for a shaving head with a blade-shaped cutting member having a single straight cutting edge, it is achieved that the contact pressure between the cutting edge of the cutting member and the skin is less dependent on the force with which the user presses the shaving head on the skin. As a result, the shaving performance and the shaving comfort of the device are less dependent on said force exerted by the user.

A particular embodiment of a device for shaving hairs in accordance with the invention is characterized in that the device further comprises a pretensioning member which defines a skin contact pressure exerted by the cutting member on the skin during operation. As a result of said pretensioning member, it is achieved that the contact pressure between the cutting edge of the cutting member and the skin is less dependent on the force with which the user presses the shaving head on the skin. As a result, the shaving performance and the shaving comfort of the device are less dependent on said force exerted by the user.

A further embodiment of a device for shaving hairs in accordance with the invention is characterized in that the pretensioning member comprises a mechanical spring mounted to the shaving head and to the base portion for exerting a pretensioning mechanical torque on the shaving head about the pivot axis. In this embodiment, the pretensioning member has a simple, practical and effective structure.

A particular embodiment of a device for shaving hairs in accordance with the invention is characterized in that the actuator is arranged in the base portion and effects the periodical motion of the cutting member via a transmission system which is partially arranged in the base portion and partially arranged in the shaving head. In this manner, the structure of the shaving head is simplified and the dimensions of the shaving head are considerably reduced. As a result, the shaving head is particularly suitable to be constructed as a detachable shaving head, which can be removed from the base portion and exchanged by a new shaving head when the cutting member is worn out.

A particular embodiment of a device for shaving hairs in accordance with the invention is characterized in that the shaving head is releasably mounted to the base portion. In this embodiment, the shaving head can be removed from the base portion and exchanged by a new shaving head when the cutting member is worn out.

A particular embodiment of a device for shaving hairs in accordance with the invention is characterized in that the cutting member is releasably mounted to the shaving head. In this embodiment, the cutting member can be removed from the shaving head and exchanged by a new cutting member when the cuffing member is worn out.

In one preferred embodiment, the base portion comprises a rotary motor having an output shaft driving a rotary transverse shaft through a gear system, wherein said transverse shaft is supported in the shaving head and positioned parallel to the cutting edge, and wherein said transverse shaft is provided with an eccentric disc at each end of it, wherein each eccentric disc is supported in a bearing in a drive member, so that at least a part of said drive member makes a reciprocating motion in a main cutting direction of the cutting member, wherein the said parts of the drive member engage both ends of the cutting member. In this embodiment the rotary motion is transferred into a reciprocating motion in the shaving head, close to the cutting member, whereby vibrations can be limited to a minimum value. Examples of this embodiment are described hereinafter as first and second embodiment of the drive mechanism.

Preferably, the cutting member is detachably engaged by the drive members, so that it can be easily renewed from time to time. Furthermore, preferably, the distance between the rotary motor and said gear system can vary because one part of the rotary shaft between the motor and the gear system can shift in axial direction in a hole in another part of that rotary shaft. Such adaptation of the length of said rotary shaft is required because the base portion hinges with respect to the shaving head around said pivot axis, which pivot axis crosses said rotary shaft at a certain distance. Preferably, there are spring means for pretensioning said one part and said another part of said rotary shaft away from each other, which pretensioning improves the hinging behavior of the shaving head.

In one preferred embodiment, the two drive members are supported in the shaving head by means of a parallel guidance mechanism(?), so that they can move only in the main cutting direction, wherein said bearing is attached to the drive member by means of another parallel guidance mechanism(?), so that the bearing can move only relative to the drive member in a direction perpendicular to the main cutting direction. As a result the eccentric rotational motion of the transverse shaft drives the drive members in an effective manner in a periodical or reciprocating motion in the main cutting direction. An example of this embodiment is hereinafter described as first embodiment of the drive mechanism.

In another preferred embodiment, each of the two drive members is hingedly supported in a tilting member, which tilting member is hingedly supported in the shaving head, wherein the location of the hinging axes is such that said part of the drive member makes a motion in the main cutting direction when the bearing of the disc makes an eccentric rotating motion. In this embodiment there are only hinging motions, and there are no mutually connected parts that shift with respect to each other. Such hinging connections have a good resistance against wear. An example of this embodiment is hereinafter described as second embodiment of the drive mechanism.

In one preferred embodiment, the base portion comprises a rotary motor having an output shaft driving two transverse members extending parallel to the cutting edge, so that the two transverse members make reciprocating motions parallel to the cutting edge in mutually opposite directions, wherein each transverse member connects said output shaft with the first end of a lever member extending substantially parallel to said output shaft, wherein both lever members are hingedly supported in the base portion so that the second ends of the lever members make opposite reciprocating motions parallel to the cutting edge, which ends engage means for driving the cutting member in a main cutting direction of the cutting member, said means being present in the shaving head. The symmetrical design and the opposite directions result in a system that is balanced in the direction parallel to the cutting edge, so that vibrations in the hand of the shaving person are minimized. Furthermore, the forces to be transferred are distributed over two levers, so that each lever has to transfer half the force to be transferred. The fact that the drive motion enters the shaving head at two sides improves the stability of the shaving head. Because the central part of the shaving device can be kept open, the shaving person has good visibility of the shaving process. Examples of this embodiment are hereinafter described as third and fourth embodiment of the drive mechanism.

Preferably, said means for driving the cutting member comprise two hinging elements pivotably attached to the shaving head as well as to the cutting member, wherein the cutting member can move in the main cutting direction in the shaving head, so that a motion parallel to the cutting edge of a part of the hinging element results in a motion in the main cutting direction of the cutting member relative to the shaving head, wherein said second ends of the lever members engage said part of the hinging element. An example of this embodiment will hereinafter be described as third embodiment of the drive mechanism. Preferably said second ends of the lever members detachably engage said part of the hinging element, so that the base portion can be separated from the shaving head. The shaving head can be a disposable portion, so that it can be renewed from time to time.

In one preferred embodiment, said means for driving the cutting member comprise two drive elements, wherein each drive element is hinged to the cutting member, wherein another part of the drive element is engaged by said second ends of the lever members, preferably detachably, so that the lever members drive said other parts parallel to the cutting edge. The two drive elements can pull and push the cutting member, but preferably they only push the cutting member, wherein the cutting member returns to its original position by spring means. In this manner a simple and effective construction is obtained. An example of this embodiment will hereinafter be described as fourth embodiment of the drive mechanism.

In one preferred embodiment, the base portion comprises a rotary motor having an output shaft driving two hinging members, which members hinge in a plane through the axis of the output shaft and extend parallel to the cutting edge, wherein a first part of each hinging member is driven by the output shaft in a reciprocating motion substantially in a direction perpendicular to the output shaft, and wherein a second part of the hinging member can make a reciprocating motion substantially parallel to the output shaft, and wherein each of said second parts is connected through drive means to the cutting member in order to drive the cutting member in a reciprocating motion in a main cutting direction of the cutting member. The hinging members are simple and effective means for transferring the reciprocating motion parallel to the cutting edge into a motion perpendicular to the cutting edge, and because two hinging members are used the drive system is balanced and each member transfers half the total force. Furthermore, the drive motion enters the shaving head at two sides, which improves the stability of the shaving head. The central part of the shaving device can be left open, so that the shaving person has good visibility of the shaving process. Examples of this embodiment will hereinafter be described as fifth and sixth embodiments of the drive mechanism.

Preferably, each hinging member is connected through pulling cables with said output shaft and/or with said drive means, wherein, as shown in the fifth embodiment of the drive mechanism described hereinafter, two pulling cables are connected to transverse members that are driven in opposite directions, in reciprocating manner, parallel to the cutting edge by the output shaft of the rotary motor, wherein each pulling cable is guided by the hinging member from a direction parallel to the cutting edge into a direction parallel to said output shaft towards the shaving head for driving the cutting member.

Furthermore, preferably, as shown in the sixth embodiment of the drive mechanism, the two hinging members are jointly made of one piece of elastic material, such as metal or plastic material, so that the two members support each other. They keep each other in the correct position and a substantial portion of the forces is balanced.

In another preferred embodiment, an example of which will not be described hereinafter , the base portion comprises a rotary motor having an output shaft driving inner cables of ends of two Bowden cables extending parallel to the cutting edge, so that the inner cables make reciprocating longitudinal motions relative to the respective outer cables, wherein each inner cable connects said output shaft to drive means for driving the cutting member in a reciprocating motion in a main cutting direction of the cutting member. A Bowden cable has the advantage that a motion can be easily transferred between parts moving relative to each other, as is the case between the handle of the shaving device and the shaving head.

In one preferred embodiment, the base portion comprises a rotary motor having an output shaft driving two transverse elements extending substantially parallel to the cutting edge, wherein the two transverse elements are substantially positioned in said pivot axis, wherein the rotary motion of the output shaft is converted into reciprocating motions in opposite directions of the two transverse elements, and wherein the ends of the transverse elements are connected with means for driving the cutting member in a main cutting direction of the cutting member. Because the motion is guided from the rotary shaft of the motor to the cutting member by an axial motion through the pivot axis, there is no influence of the transferred motion on the hinging movement of the base portion with respect to the shaving head. An example of this embodiment will be described hereinafter as seventh embodiment of the drive mechanism.

Preferably, the cutting member is attached to the shaving head by means of connection members extending in a direction perpendicular to the main cutting direction, wherein the ends of the connection members near the skin contact surface are attached to the cutting member and the ends remote from the skin contact surface are attached to the shaving head, so that the cutting member can make a reciprocating motion in the main cutting direction in the shaving head. As a result the cutting member can only make a substantial reciprocating motion in the shaving direction.

In one preferred embodiment, the shaving head comprises spring means for pushing the cutting member in the main cutting direction, so that a reciprocating motion of the cutting member can be obtained by exerting a periodical force on the cutting member in the main cutting direction . Furthermore, such spring means improves the stability of the cutting member in the shaving head.

In one preferred embodiment, the output shaft of the rotary motor is a double crankshaft in order to provide for opposing reciprocating motions parallel to the cutting edge. Such a double crankshaft is a simple construction and is for example present in the third embodiment of the drive mechanism described hereinafter.

In one preferred embodiment, the output shaft of the rotary motor is provided with one or more cam surfaces, preferably eccentric discs, in order to provide for opposing reciprocating motions parallel to the cutting edge. Such cam surfaces can be formed by one or two eccentric discs, by a rotating elliptical disc, or by an internal surface of a recess of a rotating member.

It is emphasized that the motion of the cutting member in the main cutting direction is not necessarily the only motion of the cutting member. There can also be a motion component in a Z-direction perpendicular to the main cutting direction and to the cutting edge. For example, the cutting member can make an elliptical motion in the shaving head. However, there will always be a substantial motion component in the main cutting direction.

In the following, embodiments of a device for shaving hairs in accordance with the invention and of a shaving head in accordance with the invention will be described in detail with reference to the accompanying Figures, in which FIG. 1 schematically shows an embodiment of a device for shaving hairs in accordance with the invention;

Figure 1:
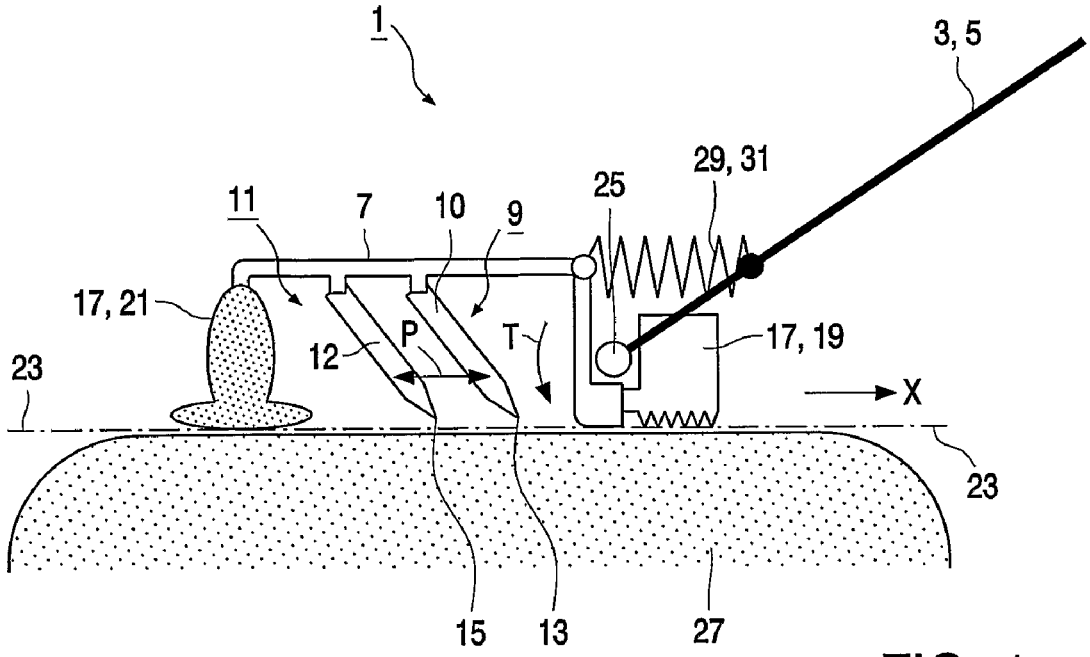

FIG. 1 only schematically shows the main parts of an embodiment of a device 1 for shaving hairs in accordance with the invention. The device 1 comprises a base portion 3 having a grip 5 by means of which a user of the device 1 can hold the device 1 in his hand. The device 1 further comprises a shaving head 7 which, in this embodiment, carries two cutting members 9, 11. The cutting members 9, 11 each comprise a cutting blade 10, 12. The cutting blades 10, 12 extend substantially parallel to each other and each comprise a single straight cutting edge 13, 15. The cutting edges 13, 15 define a main cutting direction or shaving direction X of the shaving head 7 extending substantially perpendicularly to the cutting edges 13, 15. The shaving head 7 further comprises a skin contact member 17 comprising a skin stretching element 19, which is arranged in front of the cutting members 9, 11 seen in the shaving direction X, and a skin lubricating element 21, which is arranged behind the cutting members 9, 11 seen in the shaving direction X. The skin stretching element 19 and the skin lubricating element 21 together define a skin contact surface 23 via which the shaving head 7 rests on the skin 27 during operation.

As FIG. 1 schematically indicates, during operation, the cutting members 9, 11 are driven into a periodical motion P relative to the base portion 3 and relative to the shaving head 7. In the embodiment shown, the periodical motion P is a reciprocating motion relative to the skin contact member 17 of the shaving head 7 in a direction substantially parallel to the shaving direction X . The periodical motion P is effected by an electrical actuator of the device 1, which is not shown in FIG. 1 but which will be further described in detail in the following with reference to FIGS. 2 to 5.

As a result of the periodical motion P of the cutting members 9, 11, the hair cutting action of the device 1 is considerably improved. In particular, the user perceives that the cutting forces necessary to cut the hairs growing from the skin 27 are considerably reduced. Consequently, the user can move the shaving head 7 over the skin 27 in a more convenient manner and the user experiences less irritation and pain as a result of the cutting process. As a result, both the shaving performance and the shaving comfort of the device 1 are considerably improved. In order to further improve the shaving performance and the shaving comfort and, in particular, to reduce the risk of skin irritations and skin injuries, the device 1 according to the invention comprises a pivot axis 25 about which the shaving head 7 is pivotable relative to the base portion 3. In the embodiment shown in FIG. 1, the pivot axis 25 extends parallel to the skin contact surface 23 and parallel to the straight cutting edges 13, 15 of the cutting members 9, 11, and, seen in the main cutting direction or shaving direction X, the pivot axis 25 is situated in front of the cutting edge 13 of the front cutting member 9. As a result of the pivot axis 25, during operation, the position and orientation of the shaving head 7 on the skin 27 are less dependent on, or even independent of, the manner in which the user holds the grip 5 in his hand and holds the device 1 with respect to the skin surface. The pivot axis 25 achieves that, when the device 1 is used in a common way, the shaving head 7 is always in optimum contact with the skin 27 under the influence of contact forces between the shaving head 7 and the skin 27, i.e. the skin contact surface 23 is always in substantially complete contact with the skin 27. This means that the geometrical path, which is followed by the cutting members 9, 11 during the periodical motion, has a well-defined position and orientation with respect to the skin surface. As a result, the position and orientation of said geometrical path with respect to the skin surface can be optimized during the design phase of the device 1 and the shaving head 7 in order to provide an optimum reduction of the risk of skin irritations and skin injuries. In the embodiment shown in FIG. 1, the geometrical path of the reciprocating motion P of the cutting members 9, 11 is substantially parallel to the skin contact surface 23.

In the embodiment shown in FIG. 1, the contact pressure between the cutting edges 13, 15 of the cutting members 9, 11 and the skin surface during operation is less dependent on the force with which the user presses the shaving head 7 on the skin 27, as a result of the fact that the pivot axis 25 is situated in front of the cutting edge 13 of the front cutting member 9. As a result, the shaving performance and the shaving comfort provided by the device 1 are less dependent on said force exerted by the user. In the embodiment shown in FIG. 1, said skin contact pressure exerted by the cutting members 9, 11 on the skin 27 is mainly defined by the pretensioning force of a pretensioning member 29. In the embodiment shown, the pretensioning member 29 comprises a mechanical spring 31 which is mounted to the shaving head 7 and to the base portion 3 in order to exert a pretensioning mechanical torque T on the shaving head 7 about the pivot axis 25. The pretensioning mechanical torque T can be optimized during the design phase of the device 1 and the shaving head 7 in order to provide an optimum shaving performance and an optimum shaving comfort which are less dependent on the manner in which the user manipulates the device 1.

Figure 2:
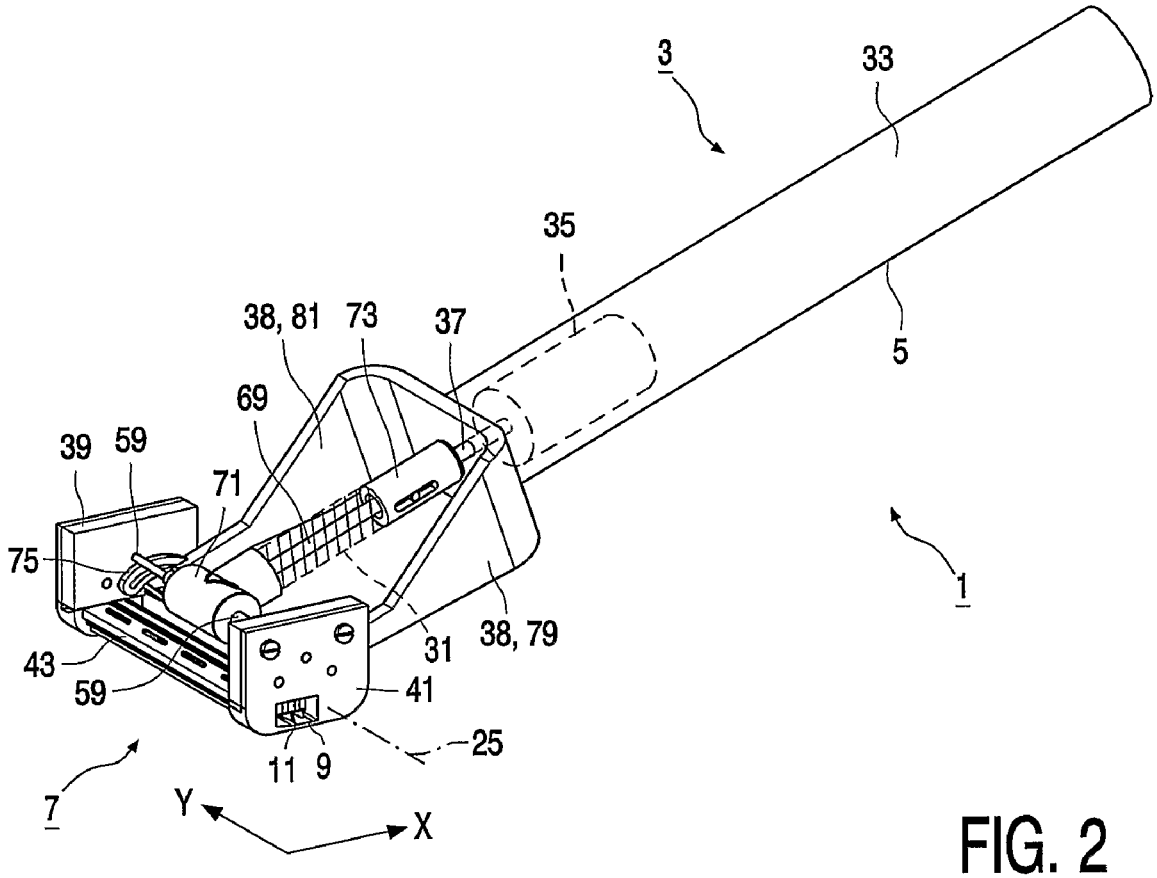
FIG. 2 shows the device of FIG. 1 in more detail.

The device 1 is shown in more detail in FIGS. 2-5, wherein parts of the device 1 already described hereinbefore are indicated by means of corresponding reference numbers. As shown in FIG. 2, the base portion 3 comprises a hollow tube 33 in which the electrical actuator mentioned hereinbefore is arranged. In the embodiment shown, the actuator is an electrical rotary motor 35 having an output shaft 37. The base portion 3 further comprises a coupling member 38 by means of which the shaving head 7 can be releasably coupled to the base portion 3 in a manner to be described in detail hereinafter.

Figure 3:
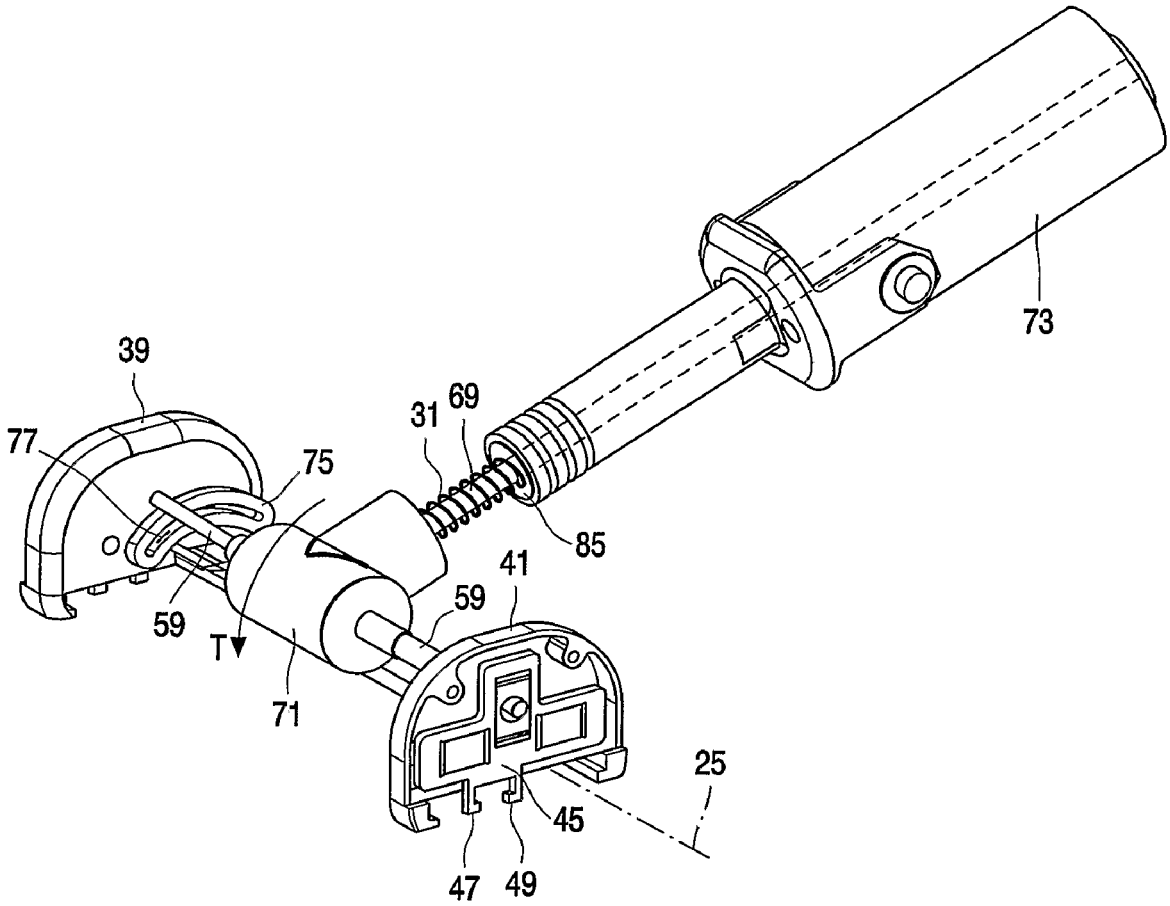
FIG. 3 shows a portion of a shaving head in accordance with the invention used in the device of FIG. 2.
Figure 4:
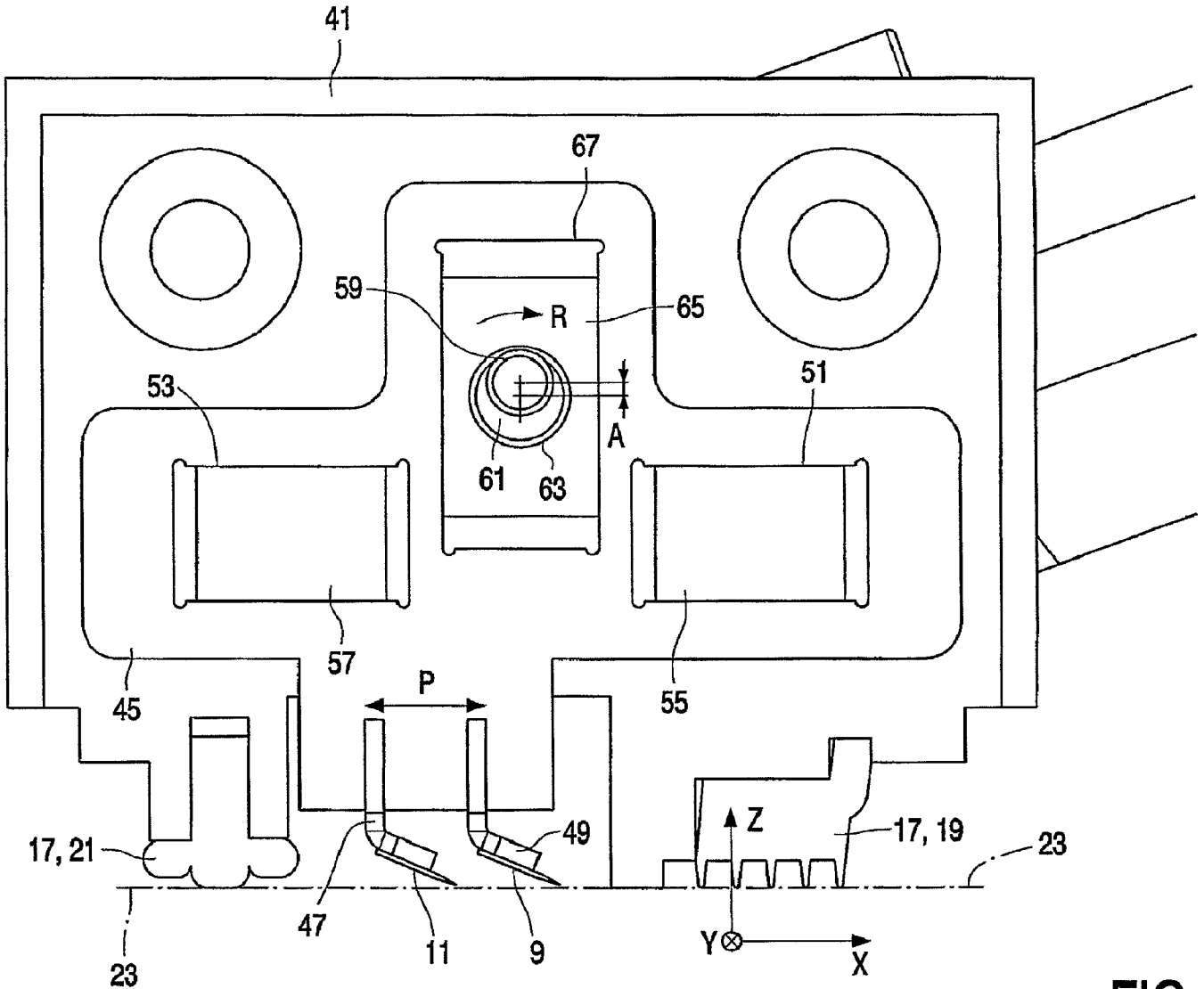
FIG. 4 is a side view of the shaving head of the device of FIG. 2.

As shown in FIG. 2, the shaving head 7 comprises a frame having two side portions 39, 41 and a bottom portion 43 connecting the side portions 39, 41. As shown in FIGS. 3 and 4, each side portion 39, 41 accommodates a supporting plate 45. The two supporting plates 45 together carry the cutting members 9, 11, which are fixed to suspension elements 47, 49 of the supporting plates 45. It is noted that the cutting members 9, 11 and the bottom portion 43 are not shown in FIG. 3 for the sake of simplicity. As shown in FIG. 4, each supporting plate 45 is movably guided relative to the relevant side portion 39, 41 in a direction parallel to the shaving direction X by means of two rectangular openings 51, 53 provided in the supporting plate 45 and two rectangular guiding elements 55, 57 mounted to the relevant side portion 39, 41. The shaving head 7 further comprises a main shaft 59, which extends parallel to the cutting edges 13, 15 of the cutting members 9, 11 and which is rotatably journalled relative to the side portions 39, 41. As shown in FIG. 4, both end portions of the main shaft 59 are provided with a circular eccentric member 61, which fits substantially without clearance in a circular opening 63 provided in a rectangular driving element 65. The driving element 65 is slidable in a Z-direction perpendicular to the shaving direction X and perpendicular to the cutting edges 13, 15 in a further rectangular opening 67 provided in the supporting plate 45, but fits substantially without clearance in said opening 67 in the shaving direction X. Thus, by means of the eccentric members 61, the driving elements 65, and the further rectangular openings 67, a rotational motion R of the main shaft 59 is converted into a reciprocating motion P of the supporting plates 45 and the cutting members 9, 11 mounted thereto in a direction parallel to the X-direction.

Figure 5:
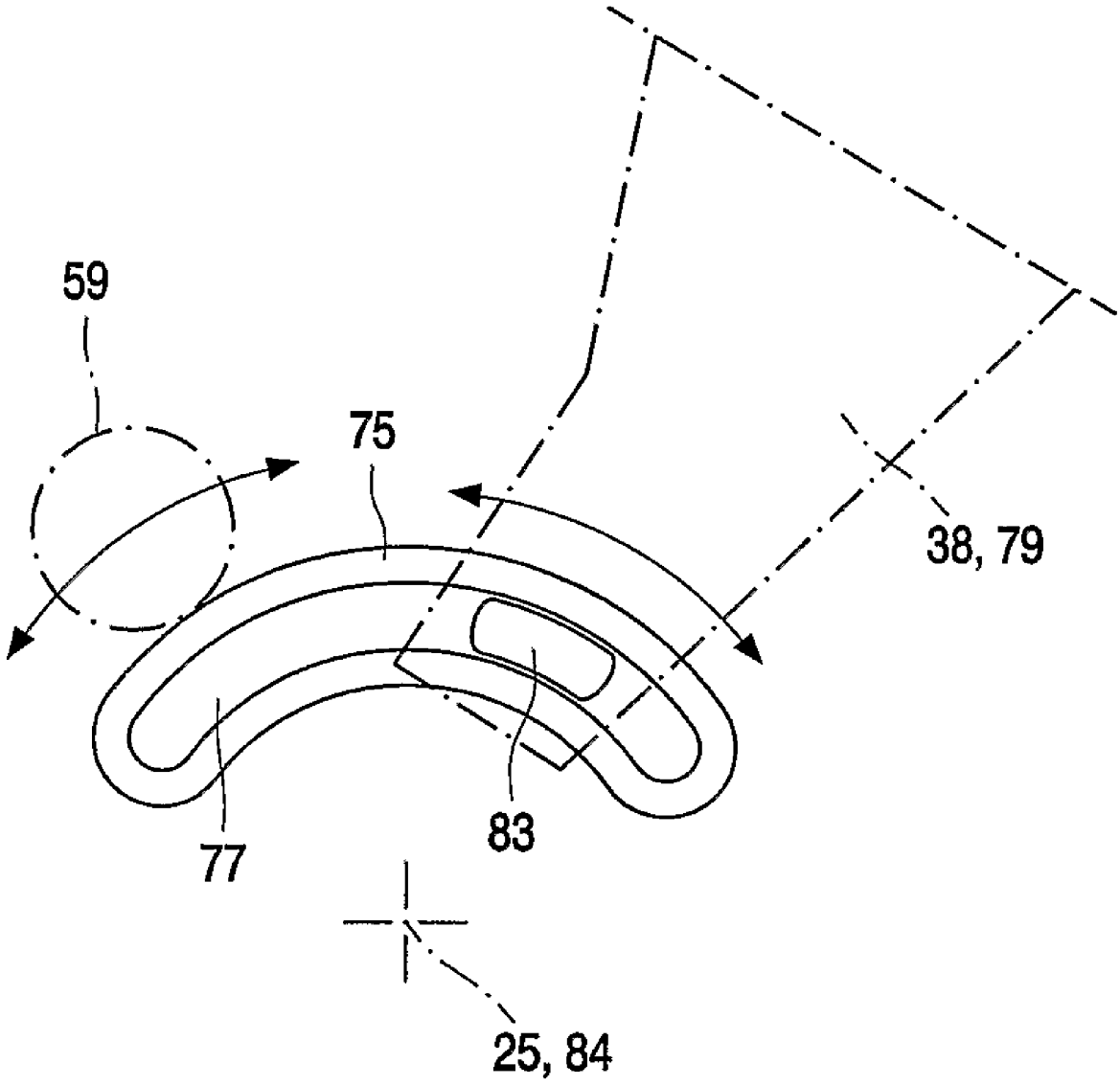
FIG. 5 shows a coupling and pivot member of the shaving head of the device of FIG. 2.

As FIGS. 2 and 3 further show, the shaving head 7 comprises an input shaft 69 and a gear system 71 for converting a rotational motion of the input shaft 69 into a rotational motion of the main shaft 59. The input shaft 69 extends through a coupling member 73 of the shaving head 7 via which the input shaft 69 can be releasably coupled to the output shaft 37 of the motor 35. As further shown in FIGS. 2 and 3, each side portion 39, 41 of the shaving head 7 comprises a circular coupling and pivot member 75 comprising a circular guiding channel 77. The coupling member 38 of the base portion 3 comprises two flexible legs 79, 81, each leg 79, 81 carrying a curved coupling and guiding element 83 on its end portion. When the shaving head 7 is coupled to the base portion 3, the coupling and guiding elements 83 are accommodated in the guiding channels 77 of the coupling and pivot members 75. The coupling and guiding elements 83 are not visible in FIGS. 2 and 3, but FIG. 5 shows one of the coupling and guiding elements 83 accommodated in the respective guiding channel 77. In the radial direction relative to the guiding channels 77, the curved coupling and guiding elements 83 fit substantially without clearance in the guiding channels 77 over their entire length, so that the coupling and guiding elements 83 only allow a rotation of the shaving head 7 relative to the base portion 3 about a common central axis 84 of the guiding channels 77. Accordingly, said central axis 84 defines the pivot axis 25 of the shaving head 7 relative to the base portion 3. The shaving head 7 can easily be released from the base portion 3 by pressing the flexible legs 79, 81 towards each other, so that the coupling and guiding elements 83 are released from the guiding channels 77, and by decoupling the input shaft 69 from the output shaft 37 via a simple axial motion of the shaving head 7 away from the base portion 3.

The mechanical spring 31 mentioned before is visible in FIGS. 2 and 3 and is arranged around the input shaft 69 of the shaving head 7. The spring 31 abuts against a first abutment surface 85, which is provided on the coupling member 73, and against a second abutment surface, which is not visible in FIGS. 2 and 3 and is provided inside the gear system 71. The mechanical spring 31 is subject to a pretension pressure, so that the spring 31 exerts the required pretensioning torque T on the shaving head 7 in the required direction as shown in FIG. 3.

As described before, the output shaft 37 of the motor 35, the input shaft 69 of the shaving head 7, the gear system 71, the main shaft 59, and the supporting plates 45 together form a transmission system via which the motor 35 arranged in the base portion 3 effects the periodical motion P of the cutting members 9, 11. Thus, said transmission system is partially arranged in the base portion 3 and partially arranged in the shaving head 7. In this manner, the structure of the shaving head 7 is simplified and the dimensions of the shaving head 7 are considerably reduced. Thus the shaving head 7 is suitable as a detachable shaving head, which can be removed from the base portion 3 and exchanged by a new shaving head 7 when the cutting members 9, 11 are wom out.

In the embodiment described before, the periodical motion P of the cutting members 9, 11 has a frequency of approximately 200 Hz. In this embodiment the eccentricity A (see FIG. 4) of the eccentric members 61 is approximately 0.2 mm, so that the periodical motion P has an amplitude of approximately 0.2 mm. In general, the preferred frequency of the periodical motion P is between approximately 100 Hz and 1000 Hz, while the preferred amplitude of the periodical motion P is between approximately 0.05 mm and 0.3 mm. It is however noted that the values of the frequency and amplitude of the periodical motion P may also be outside said preferred ranges.

It is noted that the invention also covers embodiments of a device for shaving hairs having a different kind and/or a different number of blade-shaped cutting members. The device may, for example, have a single blade-shaped cutting member or more than two blade-shaped cutting members. Instead of the cutting members 9, 11 used in the device 1 described hereinbefore, a device for shaving hairs in accordance with the invention may, for example, have a thin perforated cutting foil. Such a foil may have a regular pattern of perforations or openings, each such perforation or opening in the foil having a cutting edge.

It is further noted that the invention also covers embodiments of a device for shaving hairs in which the periodical motion of the cutting member(s) is different from the reciprocating motion (P) of the cutting members 9, 11 of the device 1. The periodical motion may, for example, have an elliptical path in an imaginary plane perpendicular to the skin contact surface or a circular or elliptical path in an imaginary plane parallel to the skin contact surface. In order to achieve a considerable improvement of the cutting action of the cutting member(s), it is preferred that the periodical motion of the cutting member(s) has a motion component which extends substantially parallel to the main cutting direction or shaving direction X of the cutting member, as is the case in the device 1 and also in the alternative devices having the elliptical or circular motions mentioned hereinbefore. In such preferred embodiments, it is further preferred that the pivot axis of the shaving head extends substantially parallel to the skin contact surface and substantially perpendicularly to the main cutting direction or shaving direction X, as is also the case in the device 1, in order to provide an optimal skin-contour following ability of the shaving head. It is however noted that the invention also covers embodiments in which the periodical motion of the cutting member(s) does not have such a motion component parallel to the main cutting direction, for example an embodiment in which a blade-shaped cutting member with a single straight cutting edge reciprocates in a direction parallel to the cutting edge. It is further noted that, in embodiments with two or more cutting members, each cutting member may be subject to a different periodical motion.

It is further noted that the invention also covers embodiments in which the shaving head 7 is not releasable from the base portion 3. In such an alternative embodiment, the cutting member(s) or a sub-frame carrying the cutting member(s) may be releasably mounted to the shaving head, so that the cuffing member(s) or said sub-frame can be removed from the shaving head and exchanged by (a) new cutting member(s) or by a sub-frame carrying (a) new cutting member(s) when the cutting members are worn out.

It is further noted that the invention also covers embodiments which do not have a pretensioning member to better define the skin contact pressure exerted by the cutting member(s) on the skin, or which have a different kind of pretensioning member. An example of such an alternative embodiment is a device in which the shaving head is pivoted relative to the base portion, and in which the cutting members are arranged in a sub-frame which is suspended in the shaving head via a pretensioning member, preferably one or more mechanical springs.

It is finally noted that the invention also covers embodiments in which the actuator for effecting the periodical motion of the cutting member(s) is arranged in the shaving head. In such an embodiment the actuator may, for example, be a piezo-electric actuator having sufficiently small dimensions.

A first embodiment of a drive mechanism for obtaining the reciprocating (or periodical) motion of the cutting member 9,11 in the shaving direction (X-direction) is shown in FIGS. 3 and 4 and was described hereinbefore. FIGS. 6 to 22 are schematic and diagrammatic representations of further examples of embodiments of a drive mechanism for the cutting member relative to the shaving head. In all these embodiments the base portion (handle) of the shaving device comprises a battery and a rotary electric motor with a rotating output shaft being coaxial with the base portion (handle). The rotating motion of the output shaft of the motor is converted into a reciprocating motion of the cutting member in the X-direction (shaving direction) relative to the shaving head by means of the drive mechanism. Apart from the movable cutting member, the shaving head comprises a skin stretching element and a skin lubricating member as is shown in FIG. 1 (reference numerals 19 and 21 respectively). The shaving head is hinged to the base portion (handle), so that the shaving head can follow the surface of the skin during the shaving process, independently of the angular position of the base portion (handle). In addition, the shaving head pivots around a pivot axis positioned near the skin stretching element and parallel to the cutting edges of the cutting blades (transverse direction or Y-direction).

Figure 6:
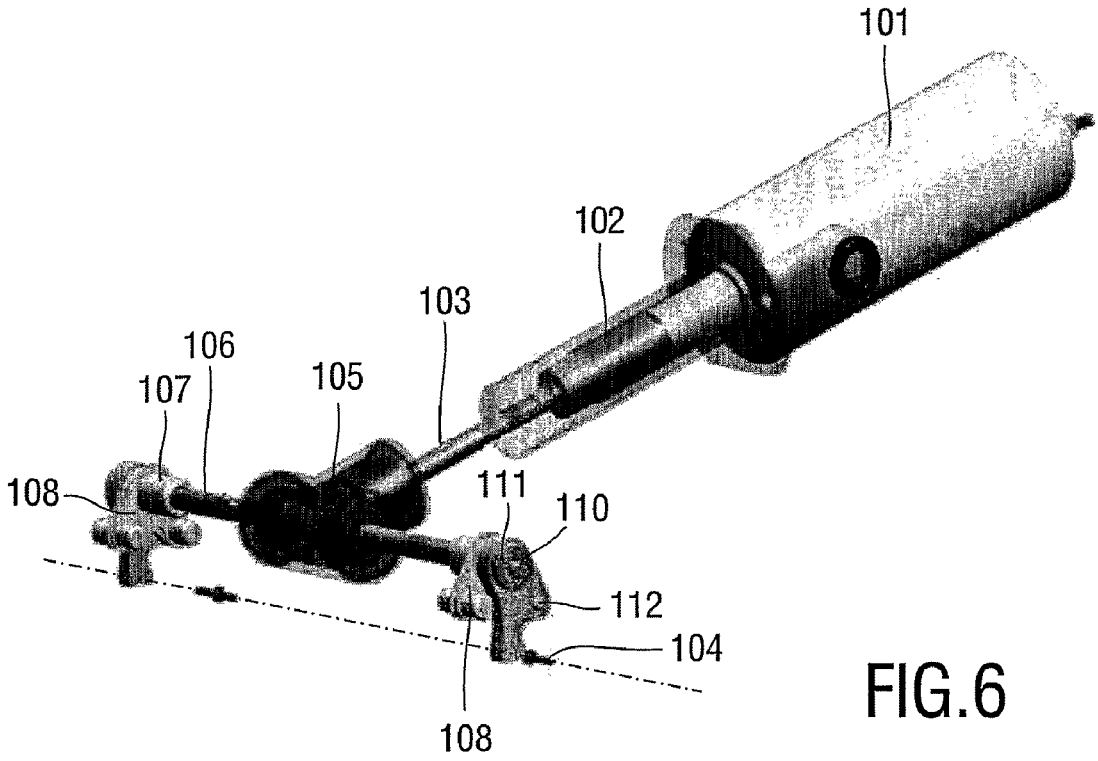
FIGS. 6-9 show a second embodiment of a drive mechanism of a device for shaving hairs in accordance with the invention.
Figure 7:
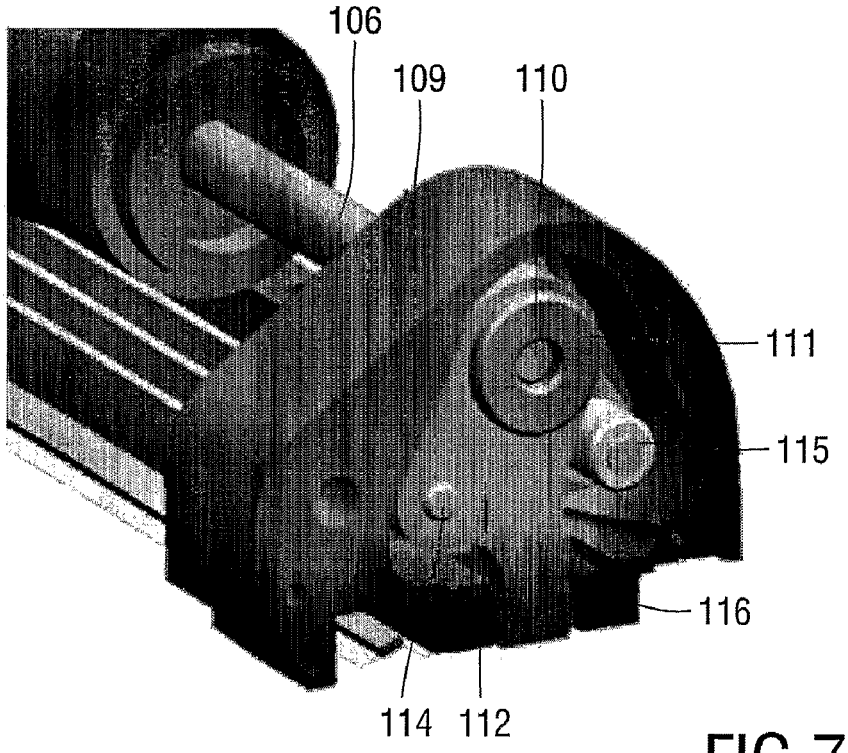
Figure 8:
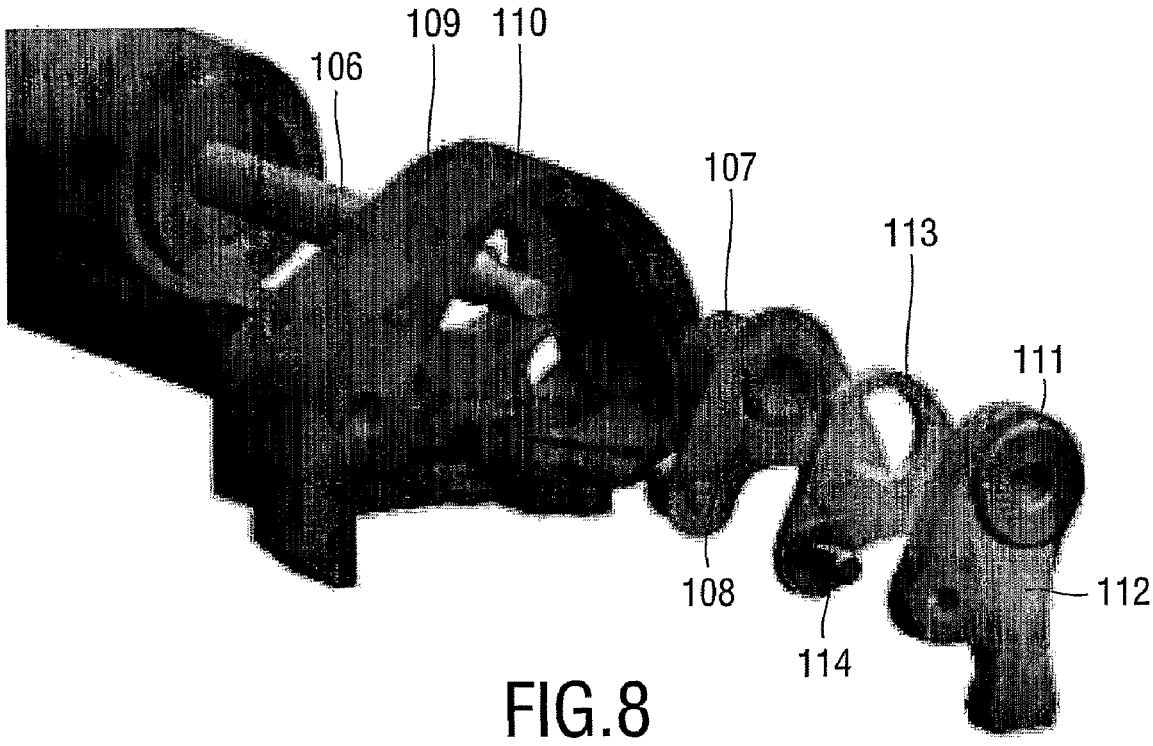

FIGS. 6-9 show a second embodiment of a drive mechanism comprising an electrical rotary motor 101 having a hollow output shaft 102. The axial hole in the hollow output shaft 102 is triangular, so that the sliding shaft 103 having a triangular cross section can axially move in the output shaft 102 of the motor 101. The motor 101, and the hollow output shaft 102, and a battery (not shown) to supply electrical power to the motor 101, are housed in the base portion (in FIG. 2 indicated by means of reference numeral 3) of the shaving device. The remainder of the drive mechanism, as shown in FIG. 6, is housed in the shaving head (in FIG. 2 indicated by means of reference numeral 7), which shaving head can rotate around a pivot axis 104 with respect to the base portion. Because the pivot axis 104 is positioned at a distance from the axis of the output shaft 102 and sliding shaft 103, the sliding shaft 103 has to slide in the axial direction with respect to the output shaft 102 when the shaving head is rotating around pivot axis 104.

FIG. 6 shows a gear system 105 for converting the rotational motion of the sliding shaft 103 into a rotational motion of the transverse shaft 106 by means of a bevelled gear on the sliding shaft 103 engaging a bevelled gear on the transverse shaft 106. Transverse shaft 106 is supported in two bearings 107 (see FIG. 8). Each bearing 107 is fixed in a support plate 108, which support plate 108 is fixed in the side portion 109 (see FIG. 7) at each side of the shaving head. The two side portions 109 are interconnected by a bottom portion that is not shown in the FIGS. 6 to 9, which bottom portion comprises the skin stretching element and the skin lubricating member (19 and 21 in FIG. 1).

Figure 9:
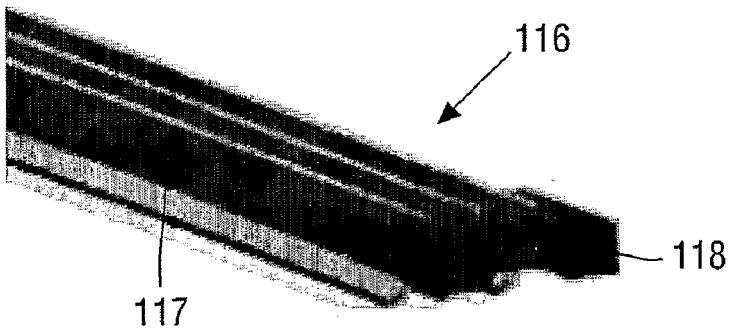

Both ends of transverse shaft 106 carry an eccentric disc 110, which eccentric disc 110 can move a bearing 111 in a circular path in a radial plane. Bearing 111 is fixed in driving yoke 112, so that driving yoke 112 can be moved by the rotation of the transverse shaft 106. Driving yoke 112 is connected with a tilting plate 113 by means of a bearing 114, and tilting plate 113 is connected with the side portion 109 by means of a bearing 115. Therefore, tilting plate 113 can rotate in side portion 109 around bearing 115, so that bearing 114 can move in a substantially vertical direction in the Figures (perpendicular to the X-direction and to the Y-direction), and therefore the lower side of driving yoke 112 makes a reciprocating motion having a substantial horizontal component, thereby moving the cutting member 116 forward and backward in the shaving direction (X-direction). As shown in FIG. 9, the cutting member 116 comprises three blades 117 with at each end a blade holder 118 supporting the three blades 117.

It will be clear that a rotary motion of the transverse shaft 106 results in a reciprocating motion of the lower part of the driving yoke 112, which reciprocating motion has a relatively large component in the shaving direction (X-direction), so that the cutting member 116 will be driven in a reciprocating motion in the shaving direction. The cutting member 116 is a disposable part, which part can be renewed from time to time.

In the third and the fourth embodiment of a drive mechanism, the motion of the rotary motor in the base portion (handle) of the shaving device is transferred to the shaving head at the location of the pivot axis, i.e. the axis around which the shaving head can rotate relative to the base portion. As a result, the transferred motion has a direction which is coaxial with respect to said pivot axis, and therefore the hinging motion of the shaving head during the shaving process action is not influenced or disturbed by the transfer of the motion.

Figure 10:
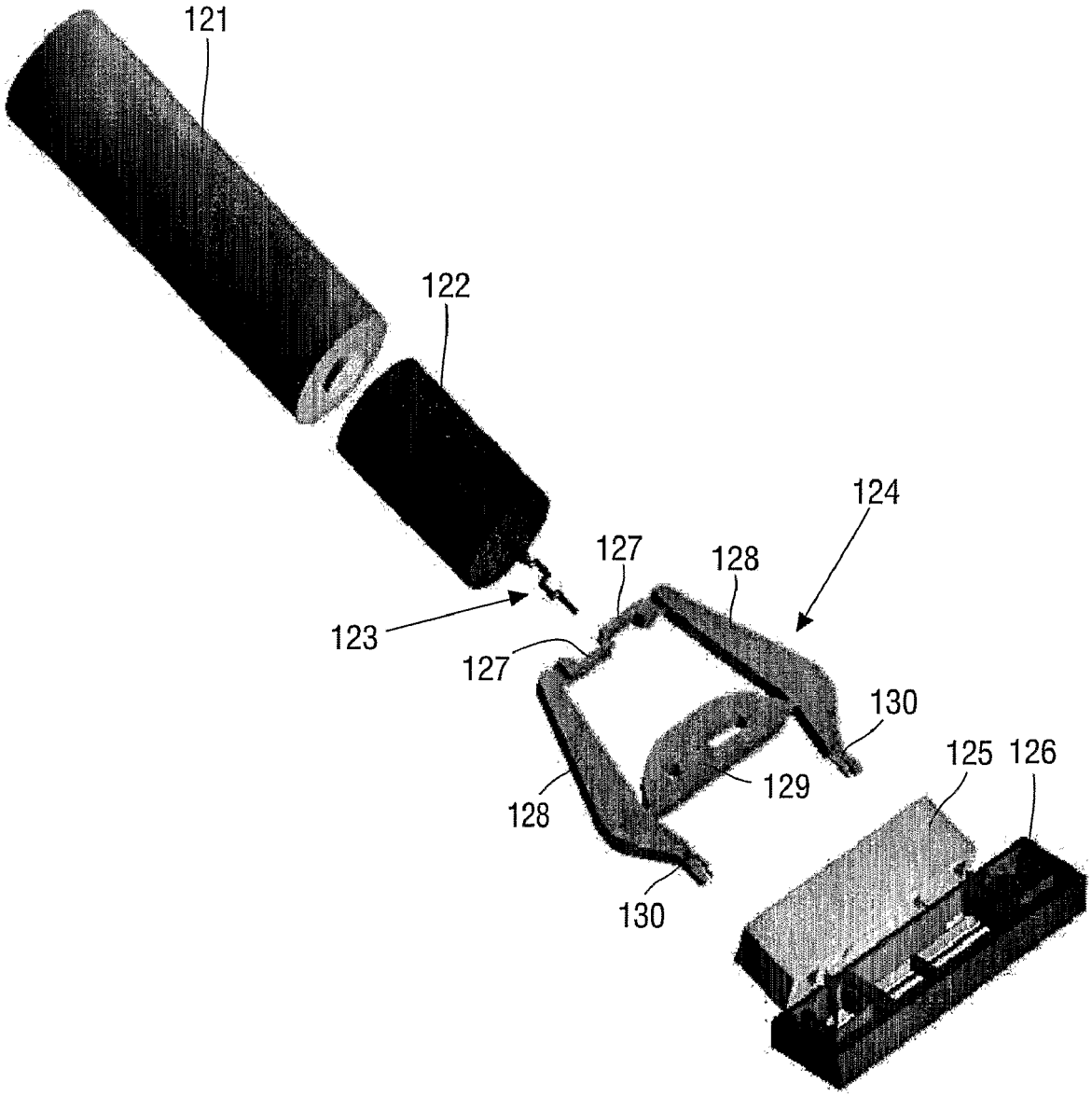
FIGS. 10-13 show a third embodiment of a drive mechanism of a device for shaving hairs in accordance with the invention.

FIGS. 10-13 show a third embodiment of the drive mechanism. FIG. 10 is a perspective and exploded view representing the battery 121 and the rotary motor 122 with a double crankshaft 123 as output shaft. These elements, together with the transfer mechanism 124, are mounted in the base portion (handle) of the shaving device. A funnel member 125 is hinged to the shaving head 126 including the cutting member and the suspension of the cutting member.

The transfer mechanism 124 is connected to the double crankshaft 123, wherein each of the two transverse members 127 engage a different eccentric part of the double crankshaft 123, so that the two transverse members 127 make reciprocating motions in opposite directions in the transverse direction (Y-direction). Each transverse member 127 is connected to a lever member 128. The lever members 128 are hinged to the ends of a supporting element 129, so that the other ends 130 of the lever members 128 also reciprocate in mutually opposite directions, i.e. towards each other and away from each other. The transfer mechanism 124 is made by one injection moulding operation and the constituent parts (transverse members 127, lever members 128 and supporting element 129) are interconnected through elastic hinges. The transfer mechanism 124 is mounted in the base portion (handle) of the shaving device, together with the rotary motor 122 and the battery 121. In order to connect the base portion (handle) of the shaving device with the shaving head 126, the ends 130 of the lever members 128 can be shifted into the funnel member 125, with the supporting element 129 being releasably attachable to the funnel member 125.

Figure 11:
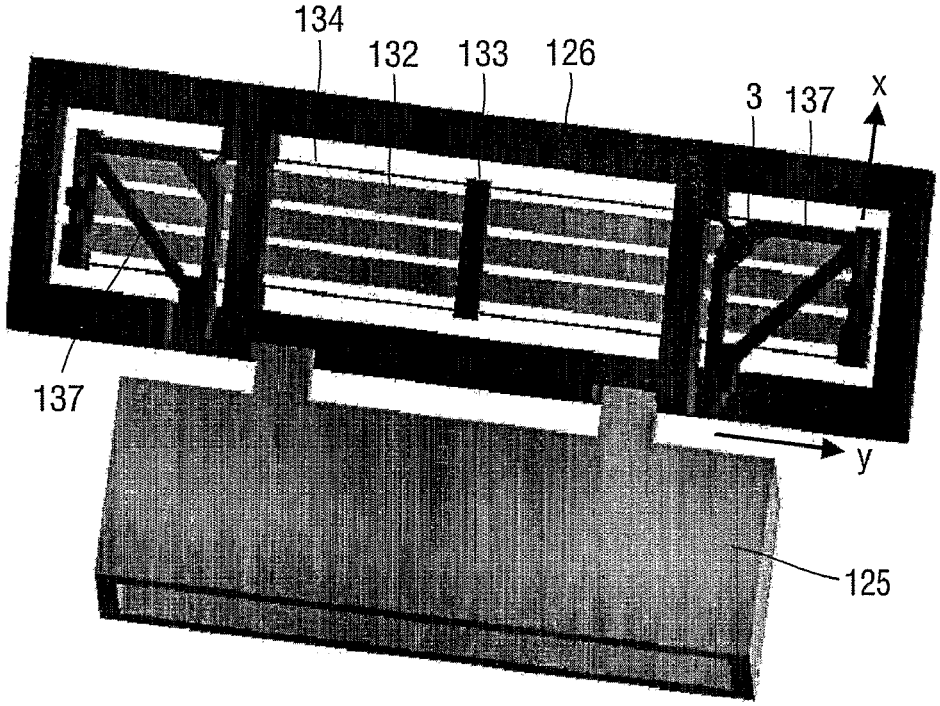
Figure 12:
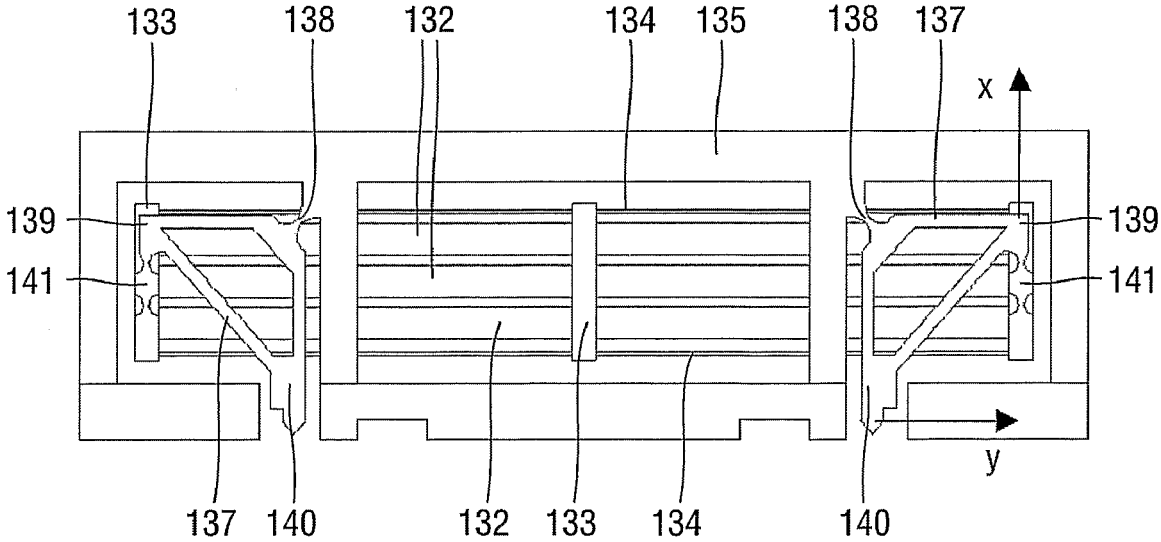
Figure 13:
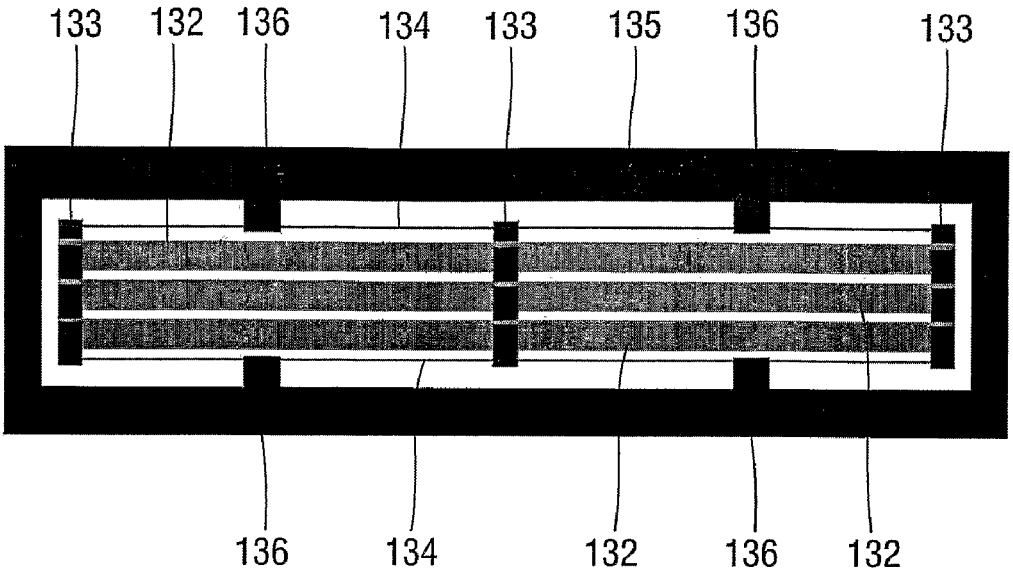

FIG. 11 is a top view of the funnel member 125 and the shaving head 126 comprising the cutting blades and the suspension of the cutting blades in more detail. FIG. 12 is a more detailed top view of the shaving head 126, and FIG. 13 is a bottom view of the shaving head 126.

The cutting member consists of three cutting blades 132 and three cross bars 133, holding the cutting blades 132, one in the middle and one at each end of the cutting blades 132. The ends of the three cross bars 133 are interconnected by two leaf springs 134, and each leaf spring 134 is attached to a frame 135 at two locations 136 (see in particular FIG. 13). Therefore, the three blades 132 can make a reciprocating motion with respect to the frame 135 in the shaving direction, indicated by means of arrow X in FIGS. 11 and 12.

The reciprocating motion of the blades 132 in the X-direction is driven by means of two hinging elements in the form of two triangle members 137. Triangle member 137 is flexibly attached to the frame 135 at point 138, so that corner 139 can move in the X-direction and corner 140 can move in the transverse direction indicated by means of arrow Y. Corners 140 can be engaged by the ends 130 of the lever members 128 (see FIG. 10) after the lever members 128 are shifted into funnel member 125. So, by means of the two triangle members 137 the reciprocating motion of said ends 130 in the Y-direction is converted to a reciprocating motion of corner 139 in the X-direction. Each corner 139 of triangle members 137 is connected through a connection bar 141 to a cross bar 133, so that the reciprocating motion in the X-direction is transferred to the blades 132.

Figure 14:
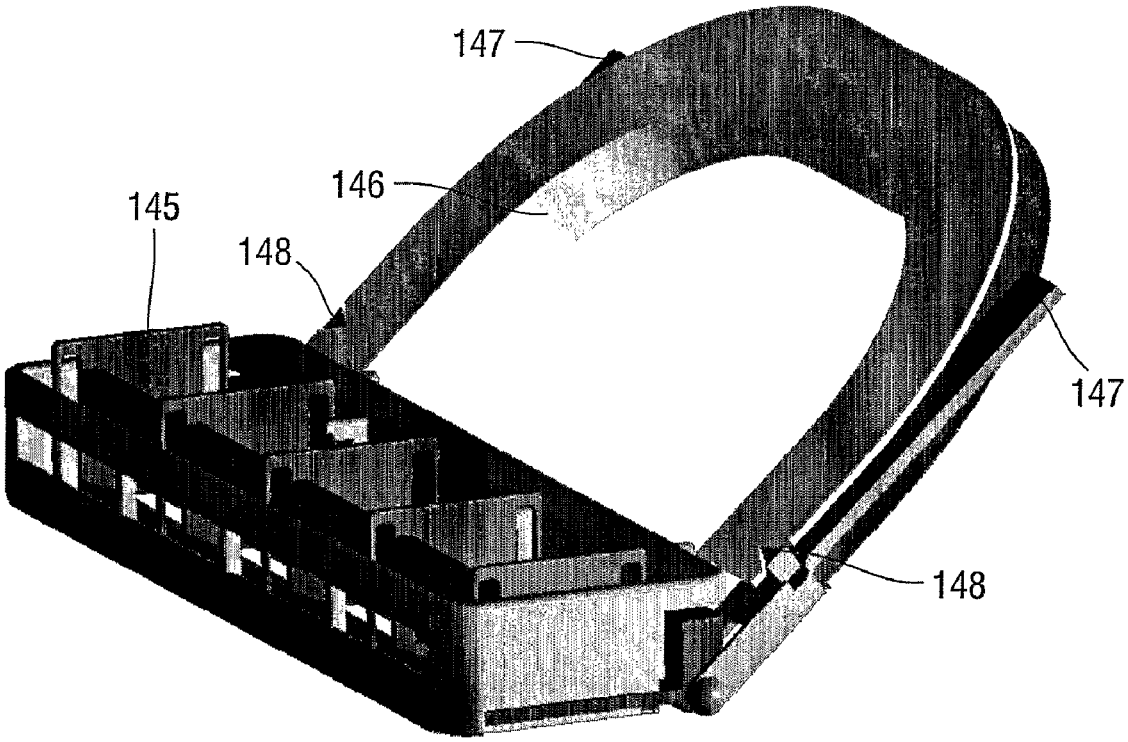
FIGS. 14-16 show a fourth embodiment of a drive mechanism of a device for shaving hairs in accordance with the invention.
Figure 15:
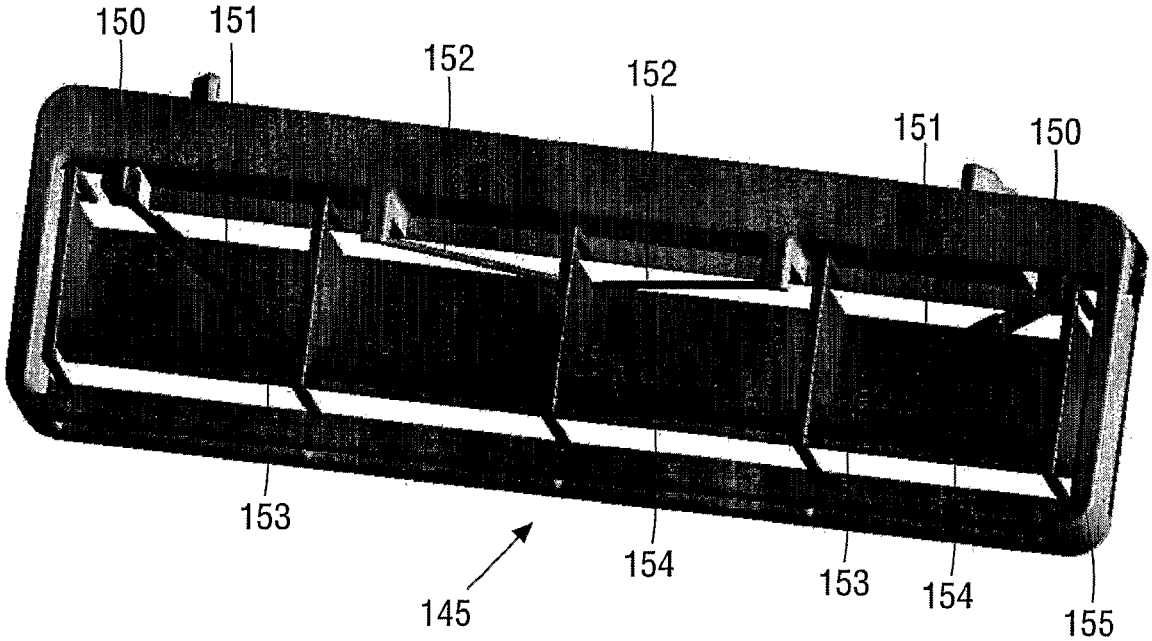
Figure 16:
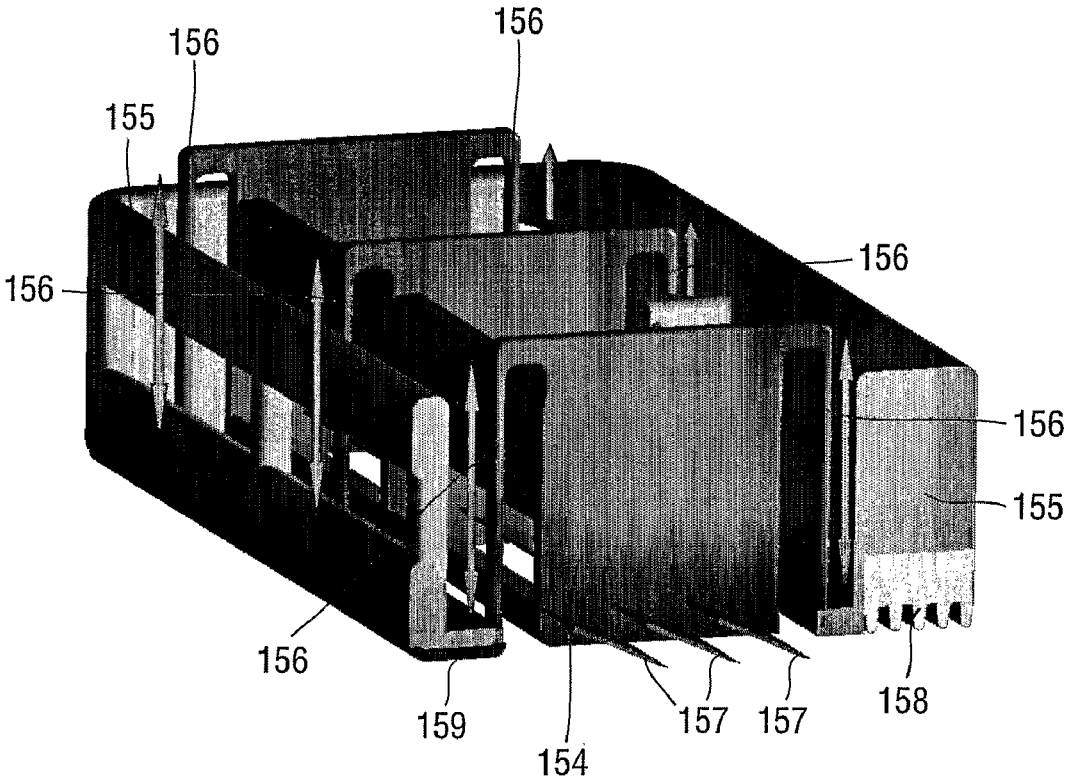

FIGS. 14-16 show a fourth embodiment of the drive mechanism. FIG. 14 is a perspective view of the shaving head 145 and the transmission housing 146 carrying a part of the drive mechanism and belonging to the base portion (handle) of the shaving device. FIG. 15 is a perspective view of the shaving head 145. FIG. 16 is a perspective view of a section of the shaving head.

The part of the drive mechanism in the housing 146 can be connected to a rotary motor via a double crankshaft as shown in FIG. 10, so that the lever members 147 move similarly to the lever members 128 of the third embodiment. The lever members 147 pivot in the housing 146 around a point indicated by means of reference numeral 148. The housing 146 is hinged to the shaving head 145, and the ends 149 of the two lever members 147 are hinged to the ends 150 of two drive elements in the form of driving rods 151 (see FIG. 15), with all these hinged connections having the same pivot axis in the transverse direction (Y-direction) and being detachable, thus allowing the base portion (handle) to be separated from the shaving head 145, being a disposable part that can be renewed from time to time.

The ends 149 of the two lever members 147 reciprocate in opposite directions and thereby drive the ends 150 of the two driving rods 151 in the transverse direction (Y-direction, parallel to the cutting blades). As shown in FIG. 15, the other ends 153 of the two driving rods 151 are hinged to the cutting member 154. Cutting member 154 is movably supported in the frame 155 of the shaving head 145, and can move in the shaving direction (X-direction). Due to the inclined positions of the two driving rods 151, motions of the ends 150 in the transverse direction (Y-direction, parallel to the cutting blades) will result in motions of the ends 153 in the shaving direction (X-direction). Two springs 152 urge the cutting member 154 in one X-direction, so that the driving rods 151 only have to push the cutting member 154 in the other X-direction.

In FIG. 16, six of the ten spring rods 156, connecting the cutting member 154 with the frame 155 of the shaving head, are represented. The spring rods 156 are positioned perpendicularly to the skin contact surface (in FIG. 1, indicated by means of reference numeral 23) and allow motion of the cuffing member 154 in the shaving direction (X-direction) relative to the frame 155. The cutting member 154 is provided with three cutting blades 157. The frame 155 of the shaving head 145 also carries a skin stretching element 158 and a skin lubricating member 159, both for abutting against the skin during the shaving process.

Figure 17:
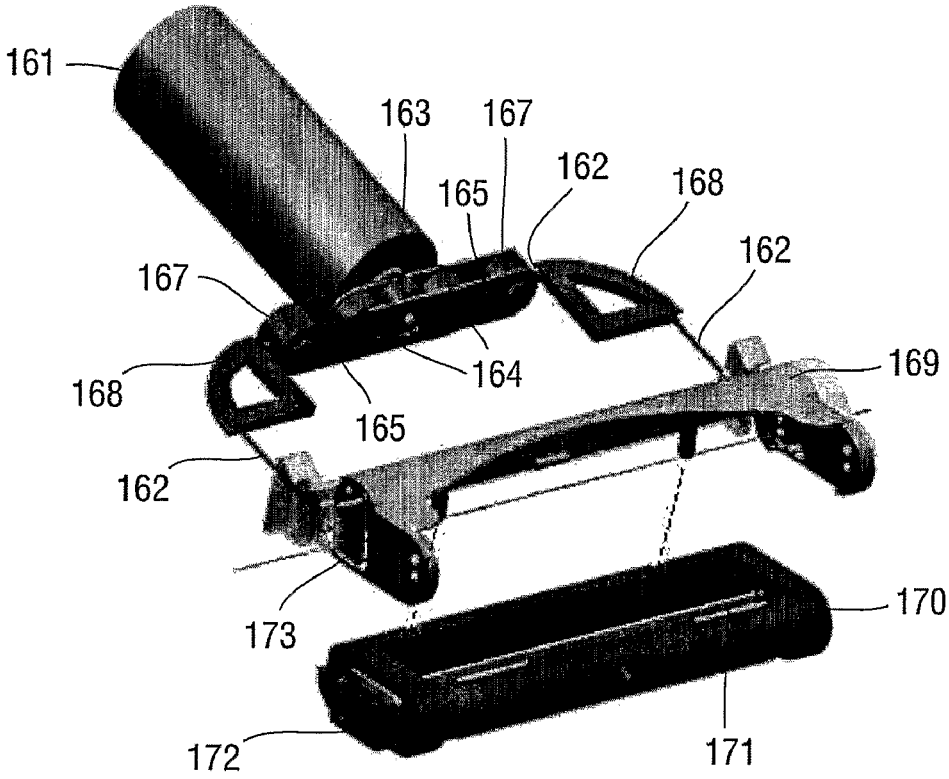
FIGS. 17-18 show a fifth embodiment of a drive mechanism of a device for shaving hairs in accordance with the invention.
Figure 18:
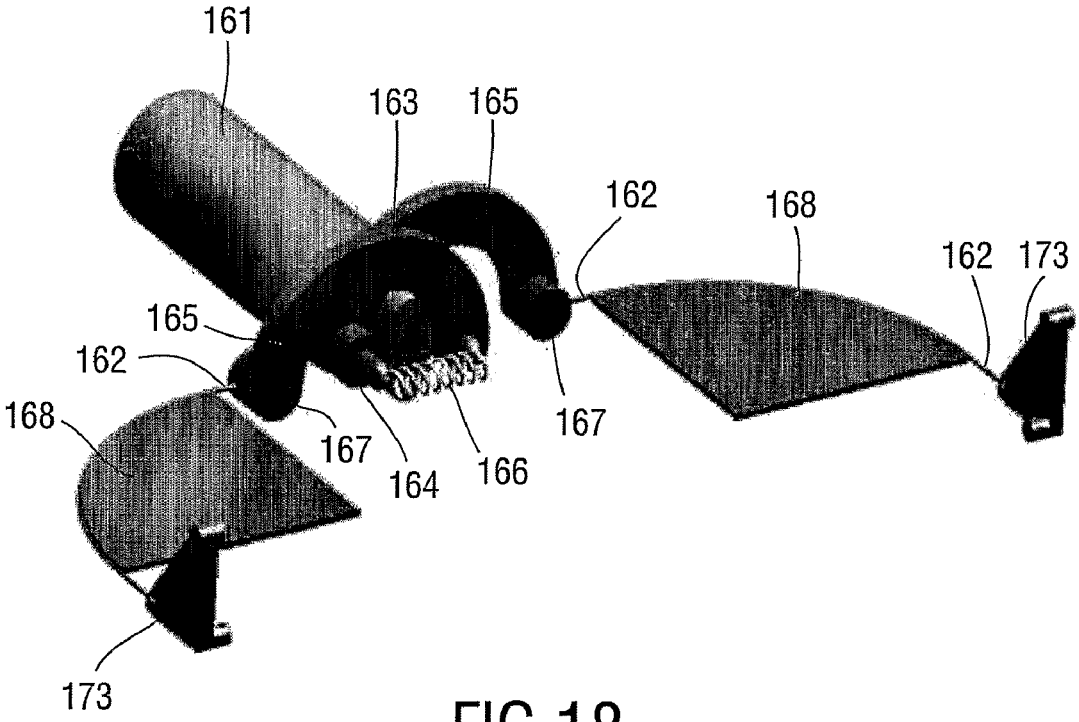

FIGS. 17 and 18 show a fifth embodiment of a drive mechanism, wherein the motion of the rotary motor 161 in the base portion (handle) of the shaving device is transferred to the shaving head by means of pulling cables 162.

According to FIG. 17, the output shaft of the rotary motor 161 is provided with a disc 163 having an oval or elliptical cam surface. Two wheels 164 are rolling over the oval cam surface of the disc 163, so that these wheels 164 make a reciprocating motion in opposite directions (in theY-direction, perpendicular to the output shaft of the motor 161). Each of the two wheels 164 is carried in a transverse member 165, so that these members also make a reciprocating motion in opposite Y-directions.

According to FIG. 17 the transverse member 165 comprises two parallel plates, and the wheel 164 rotates between these plates. The plates are provided with slots in order to accommodate the shaft of the wheel 164 of the other transverse member 165, so that the two transverse members 165 form one part extending in the Y-direction and having a varying length. According to FIG. 18 the transverse member 165 is a curved arm that can be displaced in the Y-direction by the rotating oval disc 163. In both cases the two transverse members 165 can be pulled together by means of a spring 166 (as is shown in FIG. 18), so that the two wheels 164 are pushed to the surface of the oval disc 163.

The outer ends 167 of the transverse members 165 are connected to the ends of pulling cables 162, so that these cables 162 are driven in a reciprocating longitudinal I motion by means of the transverse members 165 when the rotary motor 161 is in operation. The cables 162 are guided by hinging members 168 from a transverse direction to a direction parallel to the output shaft of the rotary motor 161 (the axial direction of the base portion or handle). The other ends of the pulling cables 162 are connected through drive means to the cutting member 171 in the shaving head, so that a pulling force in the cables can move the cutting member 171 in one X-direction, while spring means pull or push the cutting member 171 in the other X-direction.

According to FIG. 17, the shaving head comprises a cartridge holder 169 and a cartridge 170 including the cutting member 171. The cartridge 170 is provided with the skin stretching element and the skin lubricating member (reference numerals 19 and 21 in FIG. 1) and the cutting member 171 can make a reciprocating motion in the shaving direction in the cartridge 170. Both sides of the cartridge 170 are provided with a coupling element 172 that can engage a corresponding coupling element 173 in the cartridge holder 169, so that the motion of the cable 162 can be transferred through these drive means to the cutting member 171. The cartridge 170 is a disposable part that can be renewed from time to time.

Figure 19:
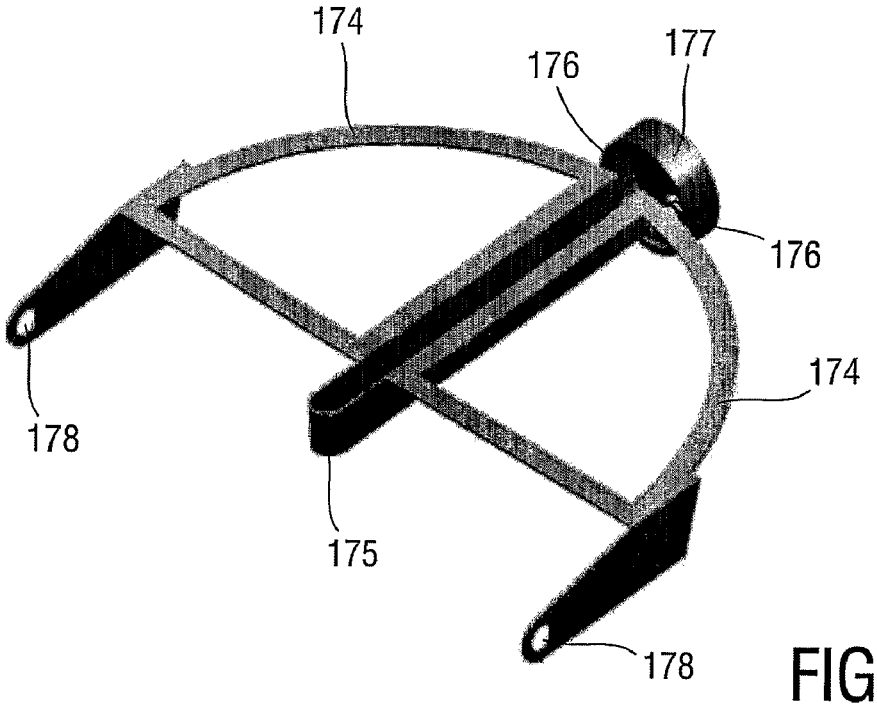
FIG. 19 shows a sixth embodiment of a drive mechanism of a device for shaving hairs in accordance with the invention.

FIG. 19 shows the two hinging members 174, which hinging members 174 are connected to each other. In the design as shown in FIG. 19, the two hinging members 174 are made out of one piece of plate metal, and part 175 interconnects the two hinging members 174. Because of the elasticity of the material, part 175 functions as a spring, causing the two hinging parts 174 to be pressed apart, so that a wheel 176 at each of the hinging members 174 is rolling over the inner cam surface of the ring 177 that is connected to the output shaft of the motor. The cam surface provides for a reciprocating motion of the two wheels 176 in opposite directions, which causes a reciprocating motion at the ends 178. Each end 178 can be connected to a pulling cable as shown in FIG. 17, to transfer the reciprocating motion to the cutting member in the shaving head. The two hinging members 174 can also be made of plastic material by means of an injection moulding operation. This drive mechanism is referred to as the sixth embodiment.

Figure 20:
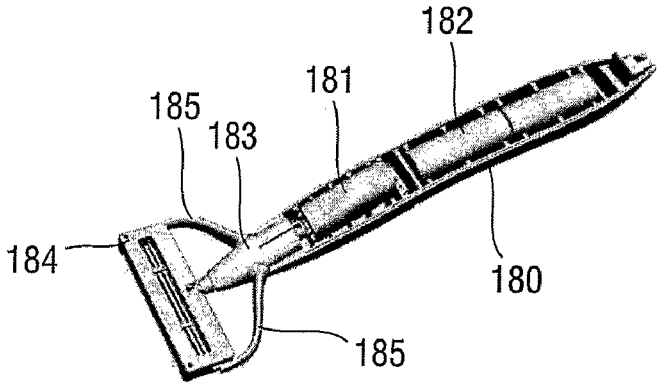
FIGS. 20-22 show a seventh embodiment of a drive mechanism of a device for shaving hairs in accordance with the invention.
Figure 21:
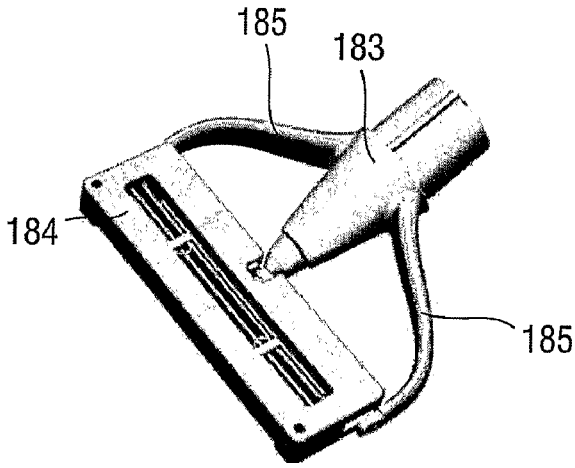
Figure 22:
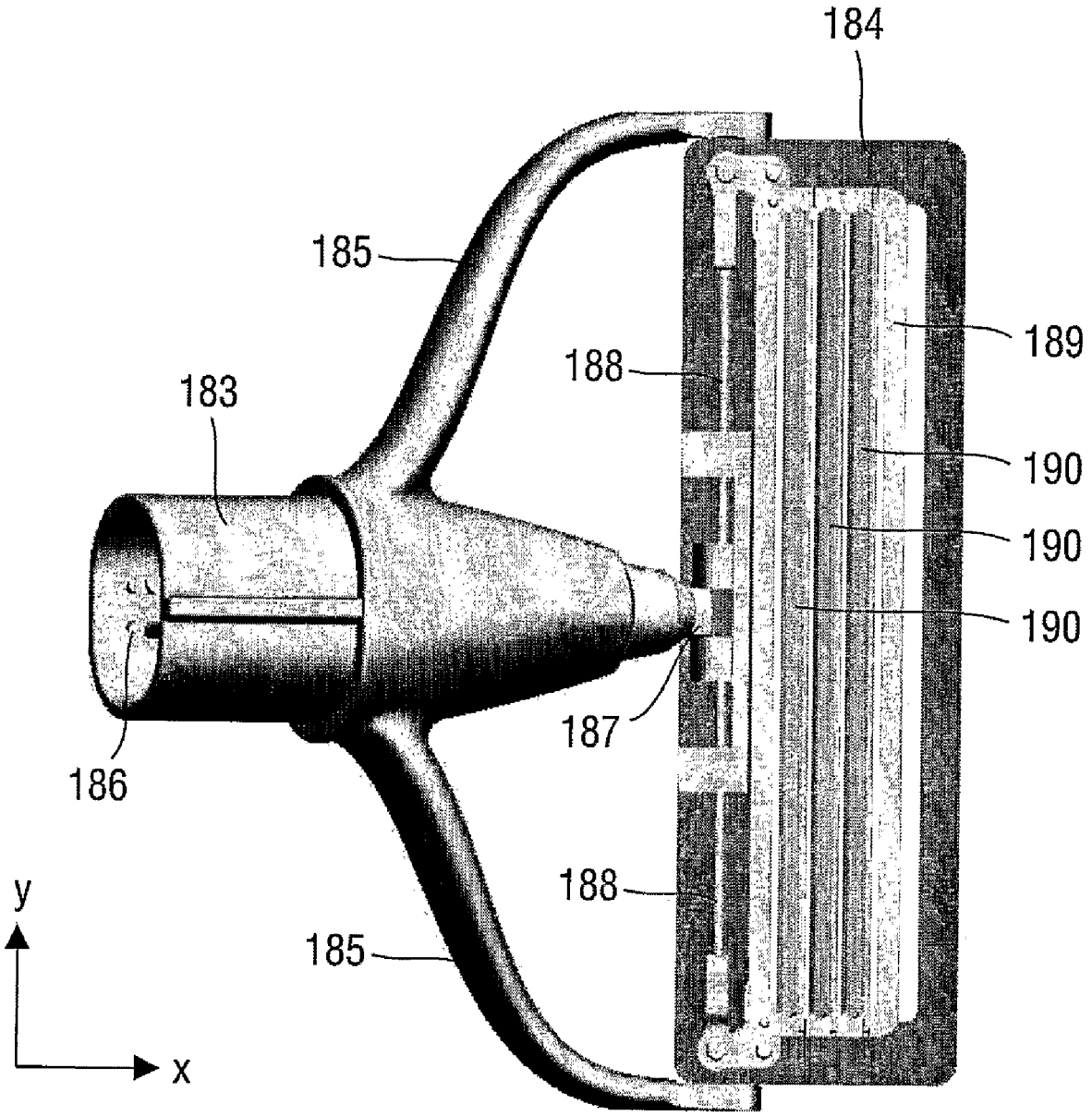

FIGS. 20-22 show the seventh embodiment of the drive mechanism. FIG. 20 is a perspective view of the shaving device, wherein a part of the housing 180 of the base portion (handle) is taken away. FIG. 21 is a perspective view of the disposable part of the shaving device, and FIG. 22 shows that part from its lower side.

FIG. 20 shows the housing 180 of the base portion, enclosing the electric rotary motor 181 and the battery 182. The base portion engages an intermediate part 183, which intermediate part 183 is connected to the shaving head 184 by means of two arms 185. The ends of the two arms 185 are hinged to the shaving head 184, so that the shaving head 184 can pivot around a pivot axis in the transverse direction (Y-direction), perpendicular to the shaving direction (X-direction).

FIG. 22 shows the intermediate part 183 and the shaving head 184 in more detail. In the intermediate part 183 there is a rotary shaft 186 that will be engaged by the output shaft of the rotary motor when the intermediate part 183 is attached to the housing 180 of the base portion. The rotary shaft 186 terminates at the location of said pivot axis, where the rotary shaft 186 is provided with a disc 187 having an oval cam surface. The rotary motion of the disc 187 is converted into two opposite reciprocating motions of the push rods 188 extending at the location of the pivot axis, i.e. in the transverse direction (Y-direction). In order to achieve that motion, the ends of the push rods 188 are pushed against the oval cam surface of the disc 187.

The other ends of the push rods 188 are connected to drive means for driving the cutting member 189 in a reciprocating motion in the shaving direction. Cutting member 189 is provided with three cutting blades 190. These drive means are not represented in detail in FIG. 22, but they can be similar to the drive means of the third embodiment (shown in FIG. 12, reference numeral 137) or of the fourth embodiment (shown in FIG. 15, reference numeral 151). Furthermore spring means can be present to push the push rods 188 against the cam surface and/or to urge the cutting member 189 in one X-direction, so that the drive means can push the cutting member in the other X-direction.

As an alternative, the disposable part of the shaving device can be limited to the cutting member 198 or to the shaving head 184, so that a larger part of the drive mechanism is part of the permanent portion of the shaving device, and hence the disposable part is smaller.

The invention claimed is:

1. A device for shaving hair growing from skin, comprising:

a base portion having a grip;

a shaving head including at least one blade-shaped cutting member having at least one cutting edge, a first side portion slidably accommodating a first supporting plate having a first suspension element, and a second side portion slidably accommodating a second supporting plate having a second suspension element, the first and second suspension elements fixed to the at least one blade-shaped cutting member;

a pivot axis wherein the base portion is pivotably coupled to the shaving head such that the shaving head pivots about the pivot axis which is perpendicular to a length of the base portion but does not pivot about an axis that is parallel to the length of the base portion, wherein the length of the base portion extends further than a width of the base portion; and an actuator coupled to the first and second supporting plates such that a rotating motion of the actuator translates into a periodical reciprocating motion of the slidably accommodated first and second supporting plates and the cutting member for effecting a periodical reciprocating motion of the cutting member relative to the base portion by the actuator slidably guiding the first and second supporting plates relative to the first and second side portions, the periodical reciprocating motion of the cutting member also being a periodical reciprocating motion of the cutting member relative to the shaving head.

2. The device as claimed in claim 1, wherein the shaving head comprises a skin contact member defining a skin contact surface, the pivot axis extending substantially parallel to the skin contact surface.

3. The device as claimed in claim 1, wherein the periodical reciprocating motion of the cutting member has a motion component which extends substantially parallel to a main cutting direction of the cutting member, the pivot axis extending substantially perpendicularly to the main cutting direction.

4. The device as claimed in claim 3, wherein the periodical reciprocating motion of the cutting member is a reciprocating motion in a direction substantially parallel to the main cutting direction.

5. The device as claimed in claim 3, wherein the cutting member comprises a single straight cutting edge, the pivot axis extending parallel to the cutting edge and, seen in the main cutting direction, being arranged in front of the cutting edge.

6. The device as claimed in claim 1, wherein the device further comprises a pretensioning member which defines a skin contact pressure exerted by the cutting member on the skin during operation.

7. The device as claimed in claim 6, wherein the pretensioning member comprises a mechanical spring mounted to the shaving head and to the base portion for exerting a pretensioning torque on the shaving head about the pivot axis.

8. The device as claimed in claim 1, wherein the coupling member comprises a transmission system, and wherein the actuator is arranged in the base portion and effects the periodical reciprocating motion of the cutting member via the transmission system which is partially arranged in the base portion and partially arranged in the shaving head.

9. The device as claimed in claim 1, wherein the shaving head is releasably mounted to the base portion.

10. The device as claimed in claim 1, wherein the cutting member is releasably mounted to the shaving head.

11. The device as claimed in claim 8, wherein the base portion comprises a rotary motor having an output shaft driving a rotary transverse shaft through a gear system, wherein said transverse shaft is supported in the shaving head and positioned parallel to the cutting edge, and wherein said transverse shaft is provided with an eccentric disc at each end of it, wherein each eccentric disc is supported in a bearing in a drive member, so that at least a part of said drive member makes a reciprocating motion in a main cutting direction of the cutting member, wherein the said parts of the drive member engage both ends of the cutting member, wherein the coupling member comprises said gear system, said traverse shaft, said eccentric disc and said drive member.

12. The device as claimed in claim 8, wherein the base portion comprises a rotary motor having an output shaft driving two transverse members extending parallel to the cutting edge, so that the two transverse members make reciprocating motions parallel to the cutting edge in mutually opposite directions, wherein each transverse member connects said output shaft with the first end of a lever member extending substantially parallel to said output shaft, wherein both lever members are hingedly supported in the base portion so that the second ends of the lever members make opposite reciprocating motions parallel to the cutting edge, which ends engage means for driving the cutting member in a main cutting direction of the cutting member, said means being present in the shaving head, wherein the coupling member comprises said two transverse members and said both lever members.

13. The device as claimed in claim 8, wherein the base portion comprises a rotary motor having an output shaft driving two hinging members, which members hinge in a plane through the axis of the output shaft and extend parallel to the cutting edge, wherein a first part of each hinging member is driven by the output shaft in a reciprocating motion substantially in a direction perpendicular to the output shaft, and wherein a second part of the hinging member can make a reciprocating motion substantially parallel to the output shaft, and wherein each of said second parts is connected through drive means to the cutting member in order to drive the cutting member in a reciprocating motion in a main cutting direction of the cutting member, wherein the coupling member comprises said two hinging members.

14. The device as claimed in claim 8, wherein the base portion comprises a rotary motor having an output shaft driving inner cables of ends of two Bowden cables extending parallel to the cutting edge, so that the inner cables make reciprocating longitudinal motions relative to the respective outer cables, wherein each inner cable connects said output shaft to drive means for driving the cutting member in a reciprocating motion in a main cutting direction of the cutting member, wherein the coupling member comprises said inner and outer cables.

15. The device as claimed in claim 8, wherein the base portion comprises a rotary motor having an output shaft driving two transverse elements extending substantially parallel to the cutting edge, wherein the two transverse elements are substantially positioned in said pivot axis, wherein the rotary motion of the output shaft is converted into reciprocating motions in opposite directions of the two transverse elements, and wherein the ends of the transverse elements are connected with means for driving the cutting member in a main cutting direction of the cutting member, wherein the coupling member comprises said output shaft and said two transverse elements.

16. The device as claimed in claim 3, wherein the device further comprises a pretensioning member which defines a skin contact pressure exerted by the cutting member on the skin during operation.

17. The device as claimed in claim 16, wherein the pretensioning member comprises a mechanical spring mounted to the shaving head and to the base portion for exerting a pretensioning torque on the shaving head about the pivot axis.

18. The device as claimed in claim 3, wherein the coupling member comprises a transmission system, and wherein the actuator is arranged in the base portion and effects the periodical reciprocating motion of the cutting member via the transmission system which is partially arranged in the base portion and partially arranged in the shaving head.

19. The device as claimed in claim 3, wherein the shaving head is releasably mounted to the base portion.

20. The device as claimed in claim 3, wherein the cutting member is releasably mounted to the shaving head.

* * * * *